US011562856B2

(12) United States Patent
Takanezawa et al.

(10) Patent No.: US 11,562,856 B2
(45) **Date of Patent: *Jan. 24, 2023**

(54) METHOD FOR MANUFACTURING ALLOY RIBBON

(71) Applicant: TOYOTA JIDOSHA KABUSHIKI KAISHA, Toyota (JP)

(72) Inventors: Yu Takanezawa, Nisshin (JP); Shota Yamagata, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 46 days.

This patent is subject to a terminal disclaimer.

(21) Appl. No.: 16/782,860

(22) Filed: Feb. 5, 2020

(65) Prior Publication Data

US 2020/0251279 A1 Aug. 6, 2020

(30) Foreign Application Priority Data

Feb. 6, 2019 (JP) ..... JP2019-019655

(51) Int. Cl.
*H01F 41/02* (2006.01)
*C21D 6/00* (2006.01)
(Continued)

(52) U.S. Cl.
CPC ..... *H01F 41/0226* (2013.01); *C21D 1/34* (2013.01); *C21D 6/00* (2013.01); *C22C 33/003* (2013.01);
(Continued)

(58) Field of Classification Search
None
See application file for complete search history.

(56) References Cited

U.S. PATENT DOCUMENTS 4,529,457 A * 7/1985 Kushnick ..... B22F 3/006 148/121
4,832,763 A * 5/1989 Rauch ..... H01F 1/15341 148/108
(Continued)

FOREIGN PATENT DOCUMENTS

CN 102741957 A 10/2012
CN 102868241 A 1/2013
(Continued)

OTHER PUBLICATIONS

JP 2020-117746 machine translation (Year: 2020).*
JP 2021-075752 machine translation (Year: 2021).*
U.S. Appl. No. 16/725,028, filed Dec. 23, 2019.

*Primary Examiner* — Paul A Wartalowicz
*Assistant Examiner* — Stephani Hill
(74) *Attorney, Agent, or Firm* — Sughrue Mion, PLLC

(57) ABSTRACT

There is provided a method for manufacturing an alloy ribbon that suppresses different magnetic properties at each position of the alloy ribbon obtained by crystallizing an amorphous alloy ribbon. The method for manufacturing an alloy ribbon includes: heating a laminated body in which positions of thick portions of a plurality of amorphous alloy ribbons are shifted to a first temperature range less than a crystallization starting temperature; and heating an end portion in a lamination direction of the laminated body to a second temperature range equal to or more than the crystallization starting temperature after the heating the laminated body. An ambient temperature is held after heating the laminated body such that the laminated body is maintained within a temperature range in which the laminated body can be crystallized by heating the end portion to the second temperature range.

3 Claims, 21 Drawing Sheets
(2 of 21 Drawing Sheet(s) Filed in Color)

(51) Int. Cl.

| | |
|---|---|
| ***C21D 1/34*** | (2006.01) |
| ***H01F 27/25*** | (2006.01) |
| ***H01F 1/153*** | (2006.01) |
| ***C22C 33/00*** | (2006.01) |

(52) U.S. Cl.
CPC ..... *H01F 1/153* (2013.01); *H01F 1/15333* (2013.01); *H01F 27/25* (2013.01)

(56) References Cited

U.S. PATENT DOCUMENTS

| | | | | | |
|---|---|---|---|---|---|
| 4,835,292 | A * | 5/1989 | Senda | C07D 309/12 549/273 |
| 2010/0018610 | A1 | 1/2010 | Petzold et al. | |
| 2013/0000795 | A1 | 1/2013 | Nakanoue | |
| 2017/0229237 | A1* | 8/2017 | Makino | H01F 27/25 |
| 2019/0173329 | A1* | 6/2019 | Nishikawa | C21D 8/0247 |

FOREIGN PATENT DOCUMENTS

| | | | | | |
|---|---|---|---|---|---|
| CN | 103258612 | A | | 8/2013 | |
| EP | 3522186 | A1 | * | 8/2019 | H01F 1/15308 |
| JP | 2011-165701 | A | | 8/2011 | |
| JP | 2016-197646 | A | | 11/2016 | |
| JP | 2017-141508 | A | | 8/2017 | |
| JP | 2020117746 | A | * | 8/2020 | |
| JP | 2021075752 | A | * | 5/2021 | |
| KR | 10-1459700 | B1 | | 11/2014 | |
| WO | WO-2018062310 | A1 | * | 4/2018 | H01F 41/005 |

* cited by examiner

METHOD FOR MANUFACTURING ALLOY RIBBON

CROSS REFERENCE TO RELATED APPLICATIONS

The present application claims priority from Japanese patent application JP 2019-019655 filed on Feb. 6, 2019, the content of which is hereby incorporated by reference into this application.

BACKGROUND

Technical Field

The present disclosure relates to a method for manufacturing an alloy ribbon obtained by crystallizing an amorphous alloy ribbon.

Description of Related Art

Conventionally, since an amorphous alloy ribbon is a soft magnetic material, a laminated body of the amorphous alloy ribbons is used as a core in, for example, a motor and a transformer. Since a nanocrystalline alloy ribbon obtained by heating and crystallizing the amorphous alloy ribbon is a soft magnetic material that ensure a high saturation magnetic flux density and a low coercivity at the same time, the laminated body of the nanocrystalline alloy ribbons has been used as their cores, recently.

When the amorphous alloy ribbon is crystalized in order to obtain the nanocrystalline alloy ribbon, a heat is generated in a crystallization, and therefore, an excessive temperature rise may be caused. As a result, coarsened crystal grains and a compound phase precipitation are generated to deteriorate soft magnetic properties in some cases.

In order to address such a problem, it is possible to use a method that increases a heat dissipation performance by heating and crystallizing the amorphous alloy ribbon in a state of being independent one by one to reduce an influence of the temperature rise caused by the heat generated in the crystallization, however, a productivity is low due to the one by one heat treatment.

Therefore, for example, JP 2017-141508 A proposes a method that suppresses a temperature rise by causing plates on both ends to absorb a heat generated in the crystallization in a method that crystallizes the laminated body by heating the laminated body from both the ends with the plates in a state where the laminated body in which the amorphous alloy ribbons are laminated is sandwiched by the plates from both the ends in the lamination direction.

JP 2011-165701 A describes a method to adjust a temperature distribution inside a laminated body during heating by heating the laminated body by sandwiching a heating machine between neighboring amorphous alloy ribbons.

SUMMARY

However, with the method proposed in JP 2017-141508 A, since the heat of reaction from a plurality of the amorphous alloy ribbons is absorbed by the plates from both the ends in the lamination direction, a thickness (number of laminations) of the laminated body is restricted to a thickness of which heat can be absorbed by the plates. Therefore, the number of the alloy ribbons that can be crystallized by a heating treatment for one laminated body is limited, thus, it is not possible to manufacture the nanocrystalline alloy ribbon obtained by crystallizing the amorphous alloy ribbon with a high productivity. It is similar even if the method proposed in JP 2011-165701 A is applied.

Meanwhile, consecutive amorphous alloy ribbon from which ribbons in a predetermined shape that constitutes a core of a motor, a transformer, or the like are punched out is difficult to manufacture with a uniform thickness, and tends to be manufactured with a non-uniform thickness with a certain tendency for each manufacturing process. In view of this, in the consecutive amorphous alloy ribbon, for example, a certain portion, such as end portions in the width direction are formed relatively thick. When a desired shaped ribbon is punched out of the consecutive amorphous alloy ribbon, a burr, sagging, and the like may be formed at end portions. From these cases, in the plurality of amorphous alloy ribbon laminated in the laminated body, relatively thick portions tend to be positioned in a certain same position. As a result, in the laminated body, the plurality of amorphous alloy ribbons are brought into contact with each other between these thick portions.

In view of this, in a method where the crystallization of the plurality of amorphous alloy ribbons is simultaneously and collectively performed by the heating treatment for the laminated body, contact portions between the alloy ribbons neighboring in the lamination direction in which the heat generated in the crystallization moves in the laminated body, in some cases, concentrates in a certain position in the planar direction. In this case, each position in the planar direction of the alloy ribbon has a different temperature history, and therefore, a uniform crystallization does not occur at each position in the planar direction of the alloy ribbon. As a result, each position in the planar direction of the alloy ribbon obtained by crystallizing an amorphous alloy ribbon has different magnetic properties.

The present disclosure has been made in view of such aspects, and provides a method for manufacturing an alloy ribbon obtained by crystallizing an amorphous alloy ribbon, and a manufacturing method that ensure suppressing a generation of different magnetic properties at each position in a planar direction of the alloy ribbon obtained by crystallizing the amorphous alloy ribbon.

In order to solve the above-described problems, a method for manufacturing an alloy ribbon according to the disclosure includes: forming a laminated body by laminating a plurality of amorphous alloy ribbons such that positions of thick portions of the plurality of amorphous alloy ribbons are shifted; heating the laminated body to a first temperature range less than a crystallization starting temperature of the amorphous alloy ribbon; and heating an end portion in a lamination direction of the laminated body to a second temperature range equal to or more than the crystallization starting temperature after the heating the laminated body. An ambient temperature around the laminated body is held after the heating the laminated body such that the laminated body is maintained within a temperature range in which the laminated body can be crystallized by heating the end portion of the laminated body to the second temperature range in the heating the end portion. When a heat amount required to heat the laminated body to the first temperature range in the heating the laminated body is Q1, a heat amount given to the laminated body when the end portion of the laminated body is heated to the second temperature range in the heating the end portion is Q2, a heat amount generated when the laminated body crystallizes is Q3, and a heat amount required to bring the whole laminated body to the crystallization starting temperature is Q4, the following formula (1) is satisfied.

$$Q1+Q2+Q3 \geq Q4 \quad (1)$$

Effect

The present disclosure ensures suppressing a generation of different magnetic properties at each position in a planar direction of an alloy ribbon obtained by crystallizing an amorphous alloy ribbon.

BRIEF DESCRIPTION OF THE DRAWINGS

The patent or application file contains at least one drawing executed in color. Copies of this patent or patent application publication with color drawings will be provided by the Office upon request and payment of the necessary fee.

DETAILED DESCRIPTION OF THE EMBODIMENTS

The following describes an embodiment of a method for manufacturing an alloy ribbon according to the present disclosure.

A method for manufacturing an alloy ribbon according to an embodiment includes: forming a laminated body by laminating a plurality of amorphous alloy ribbons such that positions of thick portions of the plurality of amorphous alloy ribbons are shifted (laminated body forming step); heating the laminated body to a first temperature range less than a crystallization starting temperature of the amorphous alloy ribbon (first heat treatment step); and heating an end portion in a lamination direction of the laminated body to a second temperature range equal to or more than the crystallization starting temperature after the heating the laminated body (second heat treatment step). An ambient temperature around the laminated body is held after the heating the laminated body such that the laminated body is maintained within a temperature range in which the laminated body can be crystallized by heating the end portion of the laminated body to the second temperature range in the heating the end portion. When a heat amount required to heat the laminated body to the first temperature range in the heating the laminated body is Q1, a heat amount given to the laminated body when the end portion of the laminated body is heated to the second temperature range in the heating the end portion is Q2, a heat amount generated when the laminated body crystallizes is Q3, and a heat amount required to bring the whole laminated body to the crystallization starting temperature is Q4, the following formula (1) is satisfied.

$$Q1+Q2+Q3 \geq Q4 \quad (1)$$

First, a method for manufacturing an alloy ribbon according to the embodiment will be exemplarily illustrated and described.

Figure 3:
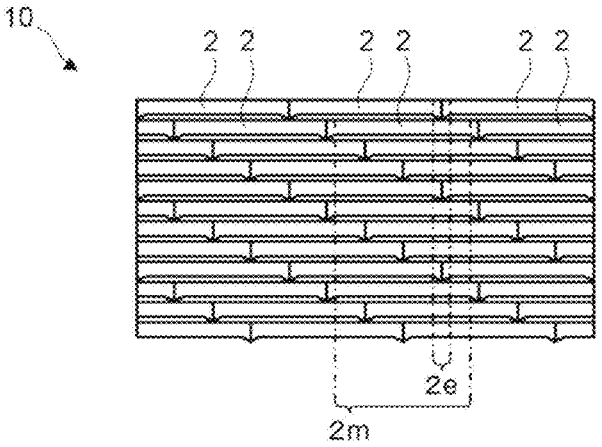
FIG. 3 is a schematic cross-sectional view taken along the line A-A in the circumferential direction in FIG. 1B.
Figure 4A:
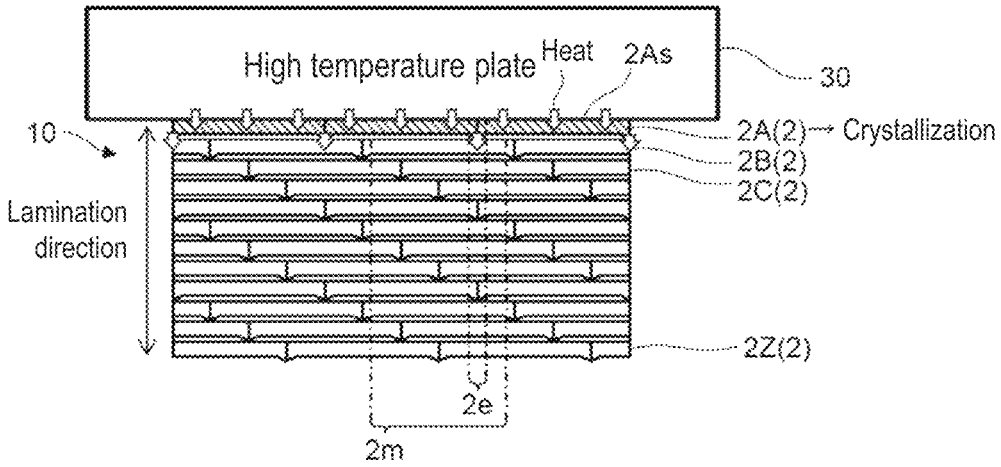
FIGS. 4A and 4B are schematic diagrams illustrating a second heat treatment step illustrated in FIG. 2B and a crystallization by the second heat treatment step.
Figure 4B:
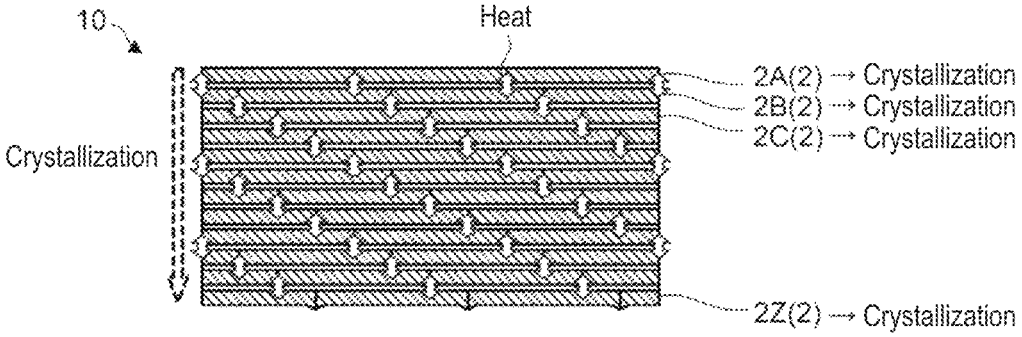
Figure 5:
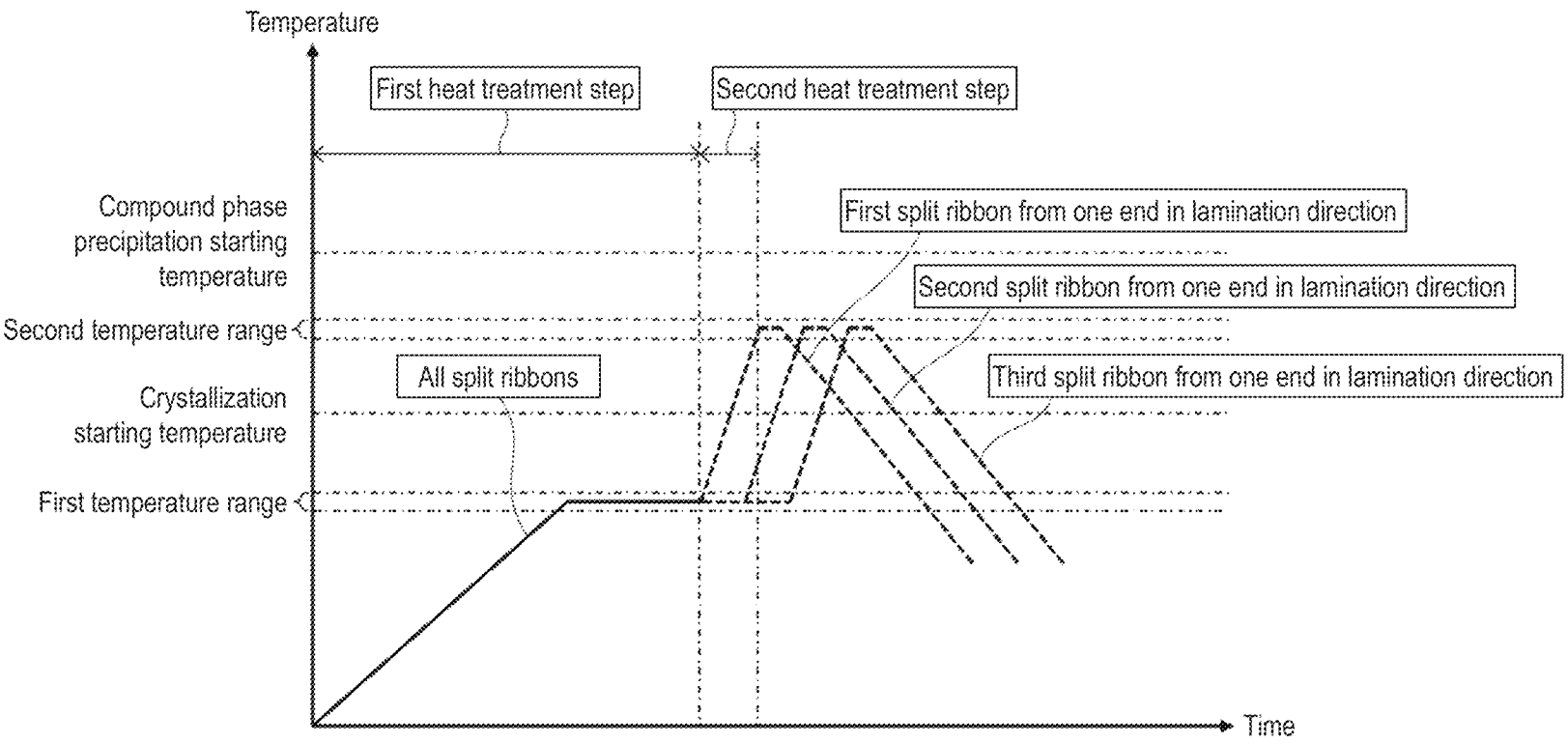
FIG. 5 is a graph schematically illustrating temperature profiles of respective split ribbons in a laminated body in the method for manufacturing the alloy ribbon illustrated in FIGS. 1A to 2B.

Here, FIGS. 1A to 2B are schematic process drawings illustrating an exemplary method for manufacturing an alloy ribbon according to the embodiment. FIG. 3 is a schematic cross-sectional view taken along the line A-A in the circumferential direction in FIG. 1B. FIG. 4A and FIG. 4B are schematic diagrams illustrating a second heat treatment step illustrated in FIG. 2B and a crystallization by the second heat treatment step. FIG. 5 is a graph schematically illustrating temperature profiles of respective split ribbons in a laminated body in the method for manufacturing the alloy ribbon illustrated in FIGS. 1A to 2B. The graph in FIG. 5 partly omits and illustrates the temperature profiles at center positions of respective split ribbons including first, second, and third split ribbons from one end in the lamination direction of the laminated body. Note that, in the following, the "lamination direction" means the lamination direction of the laminated body made by laminating a plurality of amorphous alloy ribbons, and the "planar direction" means the planar direction of the amorphous alloy ribbon.

Figure 1A:
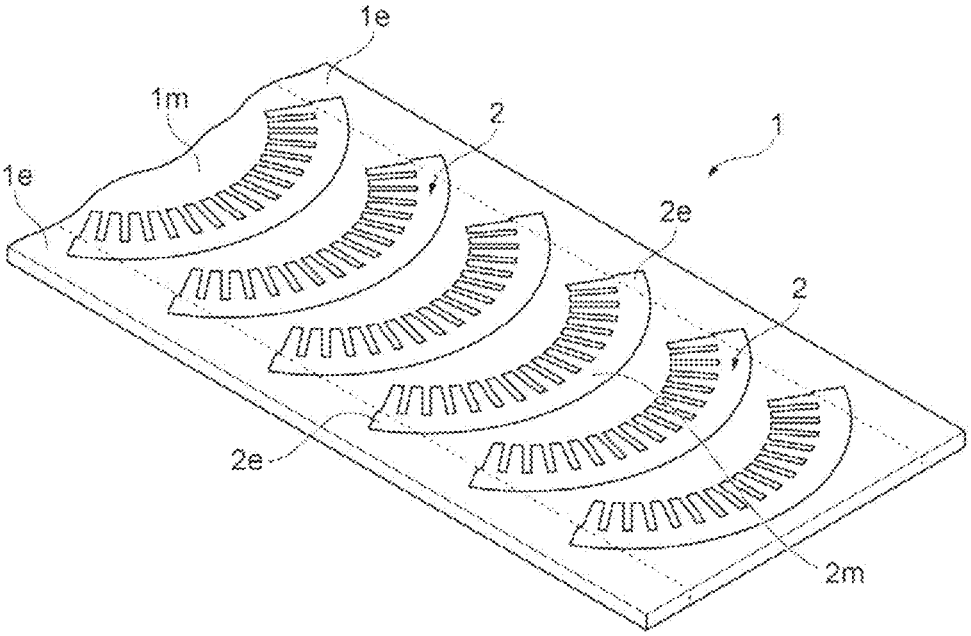
FIGS. 1A and 1B are schematic process drawings illustrating an exemplary method for manufacturing an alloy ribbon according to an embodiment.

In an exemplary method for manufacturing the alloy ribbon according to the embodiment, first, a plurality of split ribbons 2 are punched out of a consecutive amorphous alloy ribbon 1 by a presswork as illustrated in FIG. 1A. The split ribbon 2 is a ribbon which is axially symmetric with respect to the central axis of the laminated body and made by splitting a circular ribbon into one third in the circumferential direction. The circular ribbon constitutes a stator core having 48 teeth. It is difficult to uniformly manufacture the thickness of the consecutive amorphous alloy ribbon 1 by a common manufacturing method, such as a single-roll process and a twin-roll process. The thickness that is non-uniformly manufactured with a certain tendency for each manufacturing process forms both end portions 1*e* in the width direction thicker than the center portion 1*m* in some cases. When the split ribbon 2 is punched out of the consecutive amorphous alloy ribbon 1, a burr, sagging, and the like may be formed in both end portions 2*e* in the circumferential direction in some cases. As a result, all the plurality of split ribbons 2 have both the end portions 2*e* in the circumferential direction thicker than center portions 2*m*.

Figure 1B:
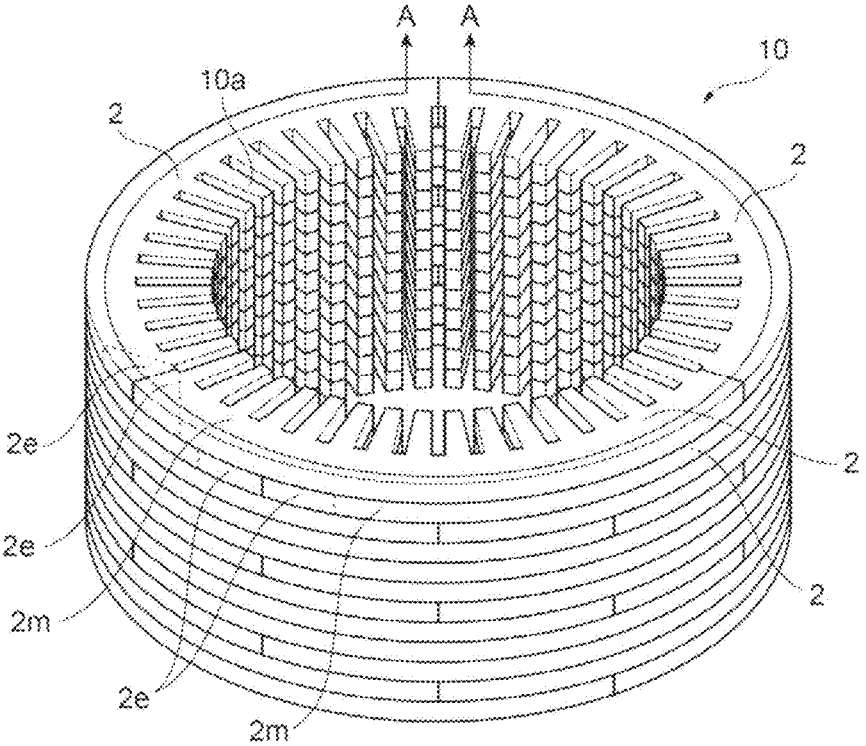

Next, as illustrated in FIGS. 1B and 3, a laminated body 10 constituting the stator core having 48 teeth 10*a* is formed by laminating the plurality of split ribbons 2 while rotating each one of the plurality of split ribbons 2 by 30 degrees in the circumferential direction with respect to the central axis of the laminated body such that the positions of both the end portions 2*e* in the circumferential direction of the plurality of split ribbons 2 one by one are shifted by 30 degrees in the circumferential direction with respect to the central axis of the laminated body (laminated body forming step). That is, each one of the plurality of split ribbons 2 is rotated and laminated at an angle of 30 degrees, and thus, the laminated body 10 is formed.

Figure 2A:
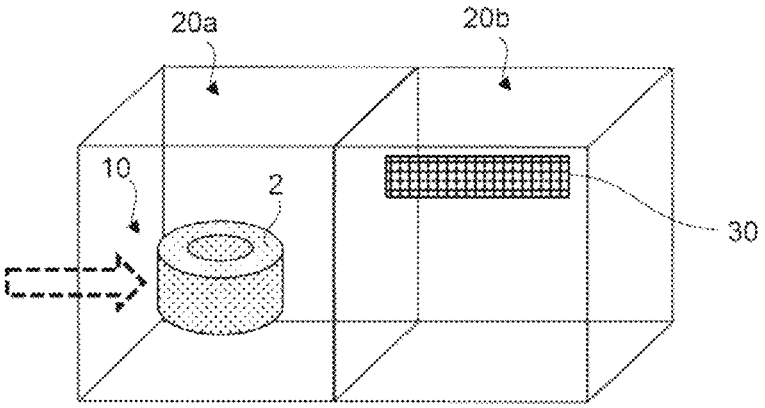
FIGS. 2A and 2B are schematic process drawings illustrating the exemplary method for manufacturing the alloy ribbon according to the embodiment.

Next, as illustrated in FIG. 2A, the laminated body 10 is moved into a first heating furnace 20*a* and then heated within a first temperature range less than a crystallization starting temperature of the split ribbon 2 by the first heating furnace 20*a* (first heat treatment step). Specifically, for example, as illustrated in the temperature profiles in FIG. 5, the whole laminated body 10 is uniformly heated such that the overall temperature of all the split ribbons 2 in the laminated body 10 falls within the first temperature range.

Figure 2B:
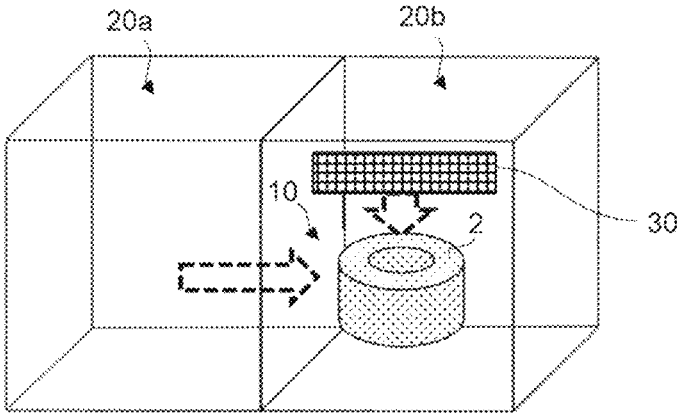

Next, as illustrated in FIGS. 2B and 4A, the laminated body 10 is moved into a second heating furnace 20*b*. A surface 2As of a first split ribbon 2A from one end in the lamination direction of the laminated body 10 is brought into contact with a high temperature plate 30 for a short period of time. This heats, in the laminated body 10, the whole first split ribbon 2A to a second temperature range equal to or more than the crystallization starting temperature while maintaining a portion other than the first split ribbon 2A within the temperature range less than the crystallization starting temperature as illustrated in the temperature profiles in FIG. 5 (second heat treatment step).

In one example according to the embodiment, after the first heat treatment step, an ambient temperature around the laminated body 10 is held such that the whole laminated body 10 is maintained within the temperature range in which the whole laminated body can be crystallized by heating the whole first split ribbon 2A to the second temperature range in the second heat treatment step. In other words, after the first heat treatment step, the ambient temperature around the laminated body 10 is held such that the whole laminated body 10 is maintained within the temperature range in which the crystallization of the whole laminated body 10 can occur by heating the whole first split ribbon 2A to the second temperature range in the second heat treatment step.

When a heat amount required to heat the whole laminated body 10 to the first temperature range in the first heat treatment step is Q1, a heat amount given to the laminated body 10 when the first split ribbon 2A is heated to the second temperature range in the second heat treatment step is Q2, a heat amount generated when the laminated body 10 crystallizes is Q3, and a heat amount required to make the whole laminated body 10 be in the crystallization starting temperature is Q4, the following formula (1) is satisfied.

$$Q1+Q2+Q3 \geq Q4 \quad (1)$$

With one example according to the embodiment, the second heat treatment step heating the first split ribbon 2A to the second temperature range equal to or more than the crystallization starting temperature in the laminated body 10 causes the first split ribbon 2A to crystallize and to generate the heat in the crystallization as illustrated in FIG. 4A. In this case, since, as described above, the ambient temperature around the laminated body 10 is held and the formula (1) is satisfied, the generated heat moves between the first split ribbon 2A and a second split ribbon 2B from the one end in the lamination direction. As a result, the second split ribbon 2B crystallizes by being heated to the second temperature range mainly by the generated heat as illustrated in the temperature profiles in FIG. 5, and generates the heat of crystallization. Similarly, a third split ribbon 2C from the one end in the lamination direction crystallizes by being heated to the second temperature range mainly by the generated heat, and generates the heat of crystallization.

Such a crystallization and the generation of heat thereby repeatedly occur such that they are transmitted from the first split ribbon 2A to a split ribbon 2Z at an end on the opposite side in the lamination direction in the laminated body 10 as illustrated in FIG. 4B. This crystallizes the whole of all the split ribbons 2 in the laminated body 10.

Figure 6:
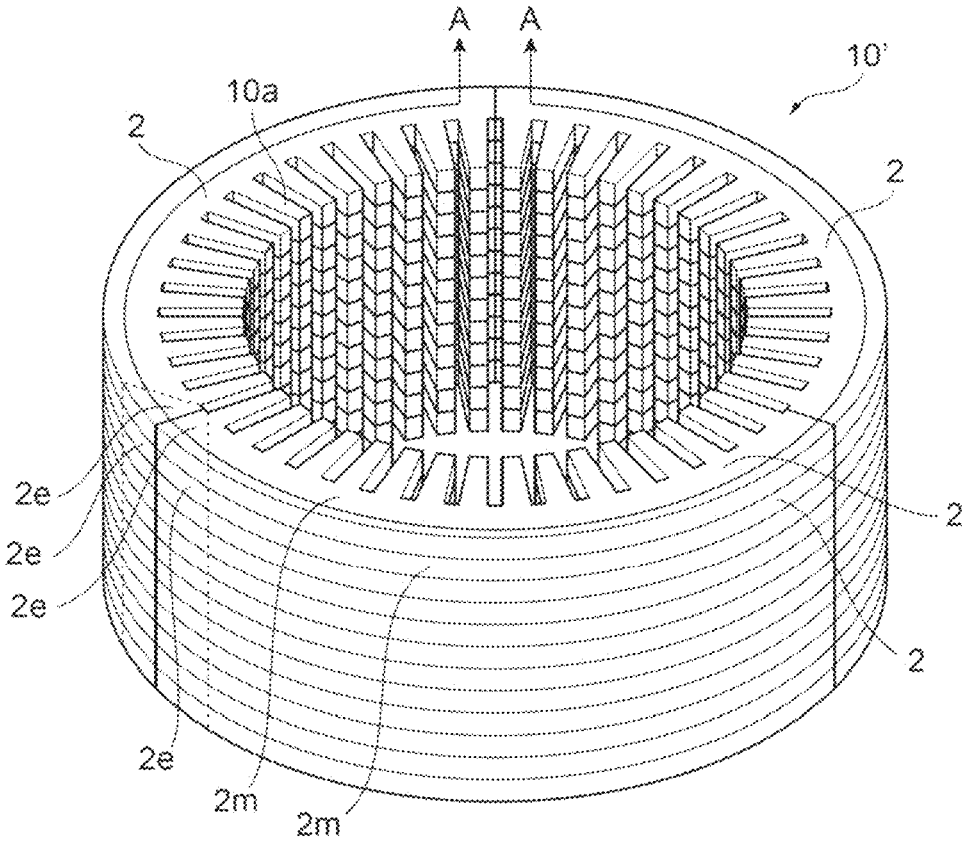
FIG. 6 is a schematic perspective view illustrating a laminated body formed in a laminated body forming step in an exemplary conventional method for manufacturing an alloy ribbon.
Figure 7:
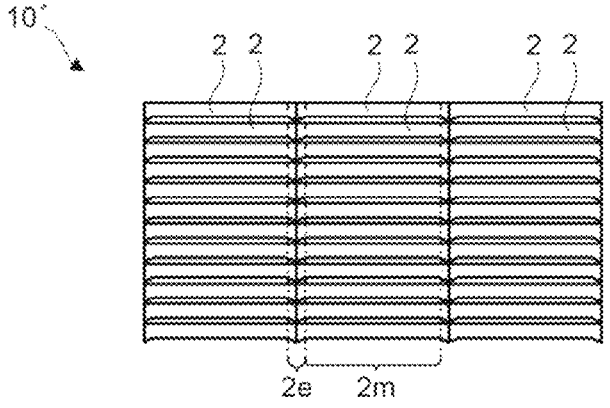
FIG. 7 is a schematic cross-sectional view taken along the line A-A in the circumferential direction in FIG. 6.
Figure 8A:
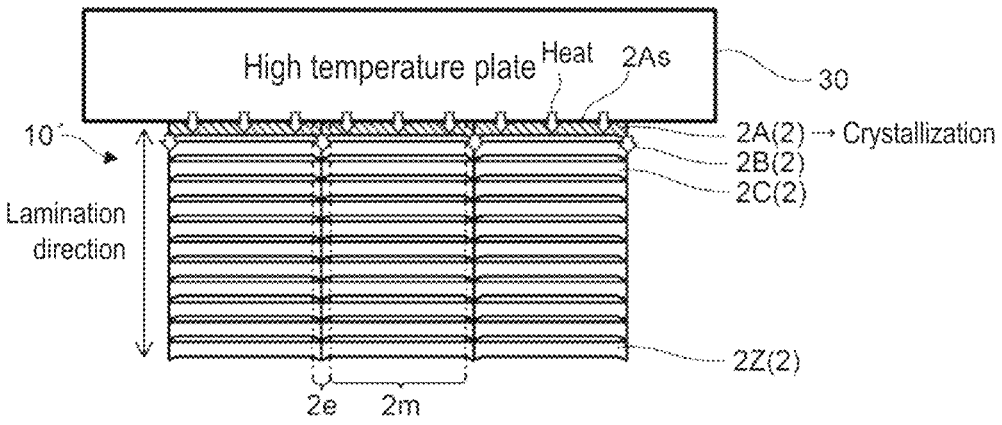
FIGS. 8A and 8B are schematic diagrams illustrating a second heat treatment step in the exemplary conventional method for manufacturing the alloy ribbon and a crystallization by the second heat treatment step.
Figure 8B:
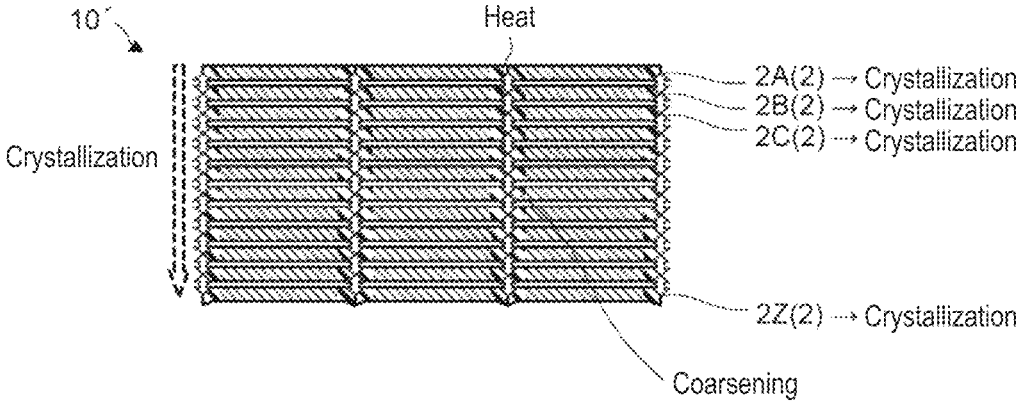

Here, an exemplary conventional method for manufacturing an alloy ribbon will be described focusing on an aspect different from the one example according to the embodiment. FIG. 6 is a schematic perspective view illustrating a laminated body formed in a laminated body forming step in the exemplary conventional method for manufacturing the alloy ribbon. FIG. 7 is a schematic cross-sectional view taken along the line A-A in the circumferential direction in FIG. 6. FIGS. 8A and 8B are schematic diagrams illustrating a second heat treatment step in the exemplary conventional method for manufacturing the alloy ribbon and a crystallization by the second heat treatment step.

In the exemplary conventional method for manufacturing the alloy ribbon, the plurality of split ribbons 2 are laminated without a rotation such that the positions of the end portions 2*e* in the circumferential direction are not shifted in the laminated body forming step as illustrated in FIGS. 6 and 7, unlike the one example according to the embodiment, and thus, a laminated body 10' constituting a stator core is formed.

Similarly to the one example according to the embodiment, after heating the whole laminated body 10' to the first temperature range in the first heat treatment step, the whole first split ribbon 2A is heated to the second temperature range in the second heat treatment step as illustrated in FIG. 8A. In view of this, as illustrated in FIG. 8B, the crystallization and the generation of heat thereby repeatedly occur such that they are transmitted from the first split ribbon 2A to the split ribbon 2Z at the end on the opposite side in the lamination direction in the laminated body 10. This crystallizes the whole of all the split ribbons 2 in the laminated body 10'.

In the laminated body 10' in the one conventional example, all the plurality of split ribbons 2 have relatively thick portions at the end portions 2*e* in the circumferential direction, and are laminated such that the positions of the end portions 2*e* in the circumferential direction are not shifted. In view of this, the plurality of split ribbons 2 are in contact with each other between the relatively thick end portions 2*e*. Accordingly, as illustrated in FIG. 8B, when the crystallization and the generation of heat thereby repeatedly occur such that they are transmitted in the lamination direction, contact portions of the split ribbons 2 neighboring in the lamination direction in which the generated heat moves are concentrated in certain positions in the planar direction. This generates a different temperature history at each position in the planar direction of the split ribbon 2, and, for example, the end portions 2*e* in the circumferential direction are exposed to a state of higher temperature than the temperature of other portions for a long period of time. This causes a failure in generating a uniform crystallization at each of the positions in the planar direction of the split ribbon 2, and the portions exposed to the state of higher temperature for a long period of time have coarsened crystals. As a result, different magnetic properties are generated at each of the positions in the planar direction of the ribbon obtained by crystallizing the split ribbon 2, and the magnetic properties at the portions exposed to the state of higher temperature for a long period of time deteriorate.

In contrast to this, in the laminated body 10 in the one example according to the embodiment, the plurality of split ribbons 2 are laminated such that the positions of the relatively thick end portions 2*e* in the circumferential direction are one by one shifted by 30 degrees in the circumferential direction. In view of this, the plurality of split ribbons 2 are in contact with each other between the relatively thick end portion 2*e* and the center portion 2*m* in the circumferential direction. Accordingly, as illustrated in FIG. 4B, the contact portions of the split ribbon 2 neighboring in the lamination direction in which the generated heat moves when the crystallization and the generation of heat thereby repeatedly occur such that they are transmitted in the lamination direction can be suppressed from concentrating in the certain positions in the planar direction. This ensures suppressing the different temperature history at each of the positions in the planar direction of the split ribbon 2, and for example, it is possible to suppress the end portions 2*e* in the circumferential direction from being exposed to the state of higher temperature for long period of time. This ensures generating the uniform crystallization at each of the positions in the planar direction of the split ribbon 2, thereby ensuring suppressing the coarsened crystals at the portions exposed to the state of higher temperature for a long period of time. As a result, the different magnetic properties at each of the positions in the planar direction of the ribbon obtained by crystallizing the split ribbon 2 can be suppressed, thereby ensuring a suppressed deterioration of the magnetic properties.

Since in the embodiment, the laminated body is formed by laminating the plurality of amorphous alloy ribbons such that the positions of the thick portions are shifted in the laminated body forming step as in the one example according to the embodiment, it is possible to avoid the plurality of amorphous alloy ribbons from being brought into contact between the thick portions in the laminated body. Therefore, in the case where the laminated body is crystallized only by the first heat treatment step and the second heat treatment step in order to manufacture the alloy ribbon obtained by crystallizing the amorphous alloy ribbon with high productivity, it is possible to suppress the contact portions of the alloy ribbons neighboring in the lamination direction, in which the generated heat moves when the crystallization and the generation of heat thereby repeatedly occur such that they are transmitted in the lamination direction, from concentrating in the certain position in the planar direction. This suppresses the generation of the different temperature history at each of the positions in the planar direction of the alloy ribbon, thereby ensuring generating the uniform crystallization at each of the positions in the planar direction of the alloy ribbon. Accordingly, it is possible to suppress the generation of the different magnetic properties at each of the positions in the planar direction of the alloy ribbon obtained by crystallizing the amorphous alloy ribbon.

Next, the method for manufacturing the alloy ribbon according to the embodiment will be described in details focusing on its conditions.

1. Laminated Body Forming Step

In the laminated body forming step, the laminated body is formed by laminating the plurality of amorphous alloy ribbons such that the positions of the thick portions of the plurality of amorphous alloy ribbons are shifted.

A method for laminating the plurality of amorphous alloy ribbons is not specifically limited as long as it is a method that laminates the plurality of amorphous alloy ribbons such that the positions of the thick portions of the plurality of amorphous alloy ribbons are shifted, and is different depending on a kind of the amorphous alloy ribbon. When the amorphous alloy ribbon is, for example, as illustrated in FIG. 1A, an axially symmetric ribbon, such as a split ribbon made by splitting a ribbon constituting a stator core in the circumferential direction, a ribbon constituting a stator core, and a ribbon constituting a rotor core, a method that laminates the plurality of amorphous alloy ribbons such that the positions of the thick portions are shifted in the circumferential direction as illustrated in FIG. 1B is usually employed.

Note that the thick portions of the plurality of amorphous alloy ribbons are not limited to both the end portions 2*e* in the circumferential direction, for example, as illustrated in FIG. 1A, but have a certain tendency for each manufacturing process.

Figure 9:
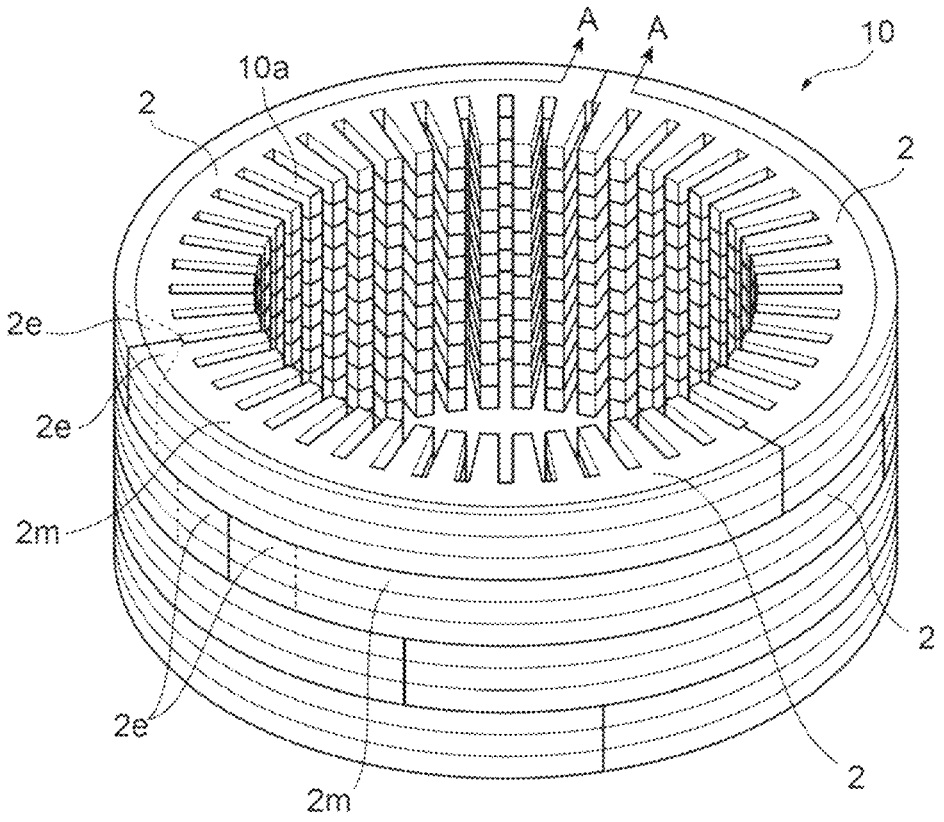
FIG. 9 is a schematic perspective view illustrating a laminated body formed in a laminated body forming step in another example of a method for manufacturing an alloy ribbon according to the embodiment.
Figure 10:
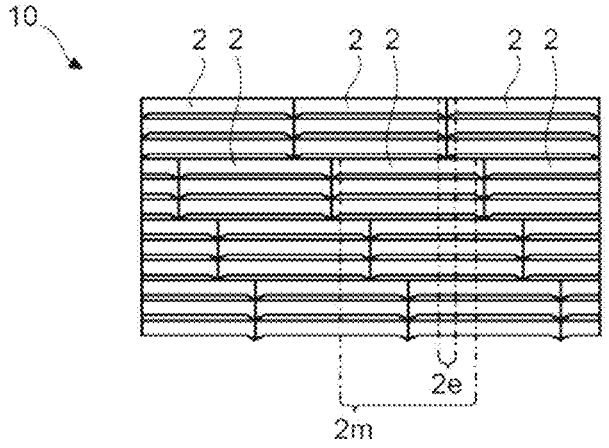
FIG. 10 is a schematic cross-sectional view taken along the line A-A in the circumferential direction in FIG. 9.

FIG. 9 is a schematic perspective view illustrating a laminated body formed in the laminated body forming step in another exemplary method for manufacturing an alloy ribbon according to the embodiment. FIG. 10 is a schematic cross-sectional view taken along the line A-A in the circumferential direction in FIG. 9.

In another exemplary method for manufacturing the alloy ribbon according to the embodiment, in the laminated body forming step, as illustrated in FIGS. 9 and 10, the plurality of split ribbons 2 are laminated while rotating every three of the plurality of split ribbons 2 by 30 degrees in the circumferential direction with respect to the central axis of the laminated body such that the positions of both the end portions 2*e* in the circumferential direction of every three of the plurality of split ribbons 2 are shifted by 30 degrees in the circumferential direction with respect to the central axis of the laminated body, and thus, the laminated body 10 constituting the stator core is formed. That is, every three of the plurality of split ribbons 2 are rotated and laminated at an angle of 30 degrees to form the laminated body 10.

The method for laminating the plurality of amorphous alloy ribbons is not specifically limited, and may be a method that laminates the plurality of amorphous alloy ribbons such that each one of the positions of the thick portions is shifted or a method that laminates the plurality of amorphous alloy ribbons such that the positions of the thick portions of every several number of amorphous alloy ribbons are shifted. In some embodiments, the method is a method that laminates the plurality of amorphous alloy ribbons such that the positions of the thick portions of every one to ten are shifted, for example, as illustrated in FIGS. 1B and 9. In some embodiments, the method is a method that laminates the plurality of amorphous alloy ribbons such that each one of the positions of the thick portions is shifted as illustrated in FIG. 1B. This is because it is possible to effectively suppress the generation of the different magnetic properties at each of the positions in the planar direction of the alloy ribbon obtained by crystallizing the amorphous alloy ribbon as a result that, in the laminated body, the contact portions of the alloy ribbons neighboring in the lamination direction being shifted at every less number of alloy ribbons ensures effectively suppressing the generation of the different temperature history at each of the positions in the planar direction of the amorphous alloy ribbon. Note that when a method that laminates the plurality of amorphous alloy ribbons such that the positions of the thick portions are shifted at every more number of alloy ribbons is used as the method for laminating the plurality of amorphous alloy ribbons, it is possible to more efficiently laminate the plurality of amorphous alloy ribbons.

The method for laminating the plurality of amorphous alloy ribbons is not specifically limited, and is different depending on a kind of the amorphous alloy ribbon. When the amorphous alloy ribbon is a split ribbon made by splitting a ribbon that constitutes a stator core in the circumferential direction or a ribbon that constitutes a stator core, for example, as illustrated in FIG. 1A, the method for laminating the plurality of amorphous alloy ribbons is usually a method that laminates the plurality of amorphous alloy ribbons such that the positions of the thick portions are shifted by an angle of integral multiple of an angle equivalent to one tooth of the stator core in the circumferential direction at each one or at every several number as illustrated in FIGS. 1B and 9. This is because portions corresponding to the teeth of the ribbon can be stacked in the lamination direction. Specifically, when the amorphous alloy ribbon is a split ribbon made by splitting a ribbon constituting the stator core having 48 teeth in the circumferential direction, for example, as illustrated in FIGS. 1B and 9, the method for laminating the plurality of amorphous alloy ribbons is a method that laminates a plurality of split ribbons such that the positions of the thick portions are shifted by 30 degrees, which is four times of 7.5 degrees equivalent to one tooth, in the circumferential direction with respect to the central axis of the laminated body at each one or at every several number.

A material of the amorphous alloy ribbon is not specifically limited as long as it is an amorphous alloy, and the material includes, for example, a Fe-based amorphous alloy, a Ni-based amorphous alloy, and a Co-based amorphous alloy. In some embodiments, it is the Fe-based amorphous alloy or the like. Here, the "Fe-based amorphous alloy" means one that includes Fe as the main component, and includes impurities, such as B, Si, C, P, Cu, Nb, and Zr. The "Ni-based amorphous alloy" means one that includes Ni as the main component. The "Co-based amorphous alloy" means one that includes Co as the main component.

In some embodiments, the Fe-based amorphous alloy, for example, has a content of Fe within a range of 84 atomic % or more, and has more content of Fe in some embodiments. This is because the content of Fe changes magnetic-flux density of the alloy ribbon obtained by crystallizing the amorphous alloy ribbon.

A shape of the amorphous alloy ribbon is not specifically limited, and the shape includes, for example, simple rectangular shape and circular shape, as well as a shape of the alloy ribbon used for a core (e.g. a stator core and a rotor core) used for parts, such as a motor and a transformer. For example, when the material is the Fe-based amorphous alloy, a size (longitudinal×lateral) of the amorphous alloy ribbon in a rectangular shape is, for example, 100 mm×100 mm, and a diameter of the amorphous alloy ribbon in a circular shape is, for example, 150 mm.

A thickness of the amorphous alloy ribbon is not specifically limited, and is different depending on the material and the like of the amorphous alloy ribbon. In the case of the Fe-based amorphous alloy, for example, the thickness is within the range of 10 μm or more and 100 μm or less, and, in some embodiments, the thickness is within the range of 20 μm or more and 50 μm or less.

The number of laminations of the amorphous alloy ribbon is not specifically limited, and is different depending on the material and the like of the amorphous alloy ribbon. In the case of the Fe-based amorphous alloy, for example, the number may be 500 or more and 10000 or less. This is because if it is excessively small in number, the nanocrystalline alloy ribbon can no longer be manufactured with high productivity, and if it is excessively large in number, conveyance and the like become hard to cause a difficulty in handling.

A thickness of the laminated body is not specifically limited, and is different depending on the material and the like of the amorphous alloy ribbon. In the case of the Fe-based amorphous alloy, for example, the thickness may be 1 mm or more and 150 mm or less. This is because if it is excessively thin, the nanocrystalline alloy ribbon can no longer be manufactured with high productivity, and if it is excessively thick, conveyance and the like become hard to cause a difficulty in handling.

2. First Heat Treatment Step

In the first heat treatment step, the above-described laminated body is heated to the first temperature range less than the crystallization starting temperature of the above-described amorphous alloy ribbon. Specifically, for example, the whole laminated body is uniformly heated such that the overall temperature of all the amorphous alloy ribbons in the laminated body falls within the first temperature range.

In the present disclosure, the "crystallization starting temperature" means a temperature at which the crystallization of the amorphous alloy ribbon starts when the amorphous alloy ribbon is heated. The crystallization of the amorphous alloy ribbon differs depending on the material of the amorphous alloy ribbon, and in the case of the Fe-based amorphous alloy, for example, it means that a fine bccFe crystal is precipitated. The crystallization starting temperature differs depending on the material and the like of the amorphous alloy ribbon and the heating speed. When the heating speed is high, the crystallization starting temperature tends to be high, and in the case of the Fe-based amorphous alloy, for example, the crystallization starting temperature falls within a range of 350° C. to 500° C.

The first temperature range is, for example, a temperature range in which the whole laminated body can be crystallized by heating the end portions of the laminated body to the second temperature range equal to or more than the crystallization starting temperature, described later in a state where the laminated body is maintained in the first temperature range.

The first temperature range is not specifically limited, and is different depending on the material and the like of the amorphous alloy ribbon. In the case of the Fe-based amorphous alloy, for example, it may be within a range equal to or more than the crystallization starting temperature −100° C. and less than the crystallization starting temperature. This is because, if it is excessively low, there is a possibility of failing to crystallize the whole laminated body by the second heat treatment step. This is also because, if it is excessively high, there is a possibility of occurrence of coarsened crystal grains in the laminated body and precipitation of a compound phase by the second heat treatment step, and depending on the variation of the material of the alloy ribbon, there is a possibility that crystallization may partly starts by the first heat treatment step.

3. Second Heat Treatment Step

In the second heat treatment step, after the above-described first heat treatment step, the end portion in the lamination direction of the above-described laminated body is heated to the second temperature range equal to or more than the crystallization starting temperature. Specifically, after the first heat treatment step, the end portion in the lamination direction of the laminated body is heated to the second temperature range equal to or more than the crystallization starting temperature, and is held in the second temperature range for a period of time necessary for crystallization, while maintaining the portion other than the end portion in the lamination direction of the laminated body within the temperature range less than the crystallization starting temperature. Thus, the amorphous alloy at the end portions of the laminated body is crystallized to obtain a nanocrystalline alloy.

While the second temperature range is not specifically limited, it may be a temperature range less than a compound phase precipitation starting temperature. This is because it is possible to suppress the precipitation of the compound phase. In the present disclosure, the "compound phase precipitation starting temperature" means a temperature at which the precipitation of the compound phase starts when the alloy ribbon after the crystallization is further heated. The "compound phase" means a compound phase, such as Fe—B and Fe—P in a case where it is the Fe-based amorphous alloy, which is precipitated when the alloy ribbon after the crystallization is further heated and which significantly deteriorates soft magnetic properties compared with a case of coarsened crystal grains.

The second temperature range is not specifically limited, and is different depending on the material and the like of the amorphous alloy ribbon. In the case of the Fe-based amorphous alloy, for example, it may be within a range of the crystallization starting temperature or more and less than the crystallization starting temperature+100° C., in some cases, it may be within a range of the crystallization starting temperature+20° C. or more and less than the crystallization starting temperature+50° C. This is because, if it is excessively low, there is a possibility of failing to crystallize the whole laminated body, and if it is excessively high, there is a possibility of occurrence of coarsened crystal grains in the laminated body and the precipitation of the compound phase.

The method for heating the end portions in the lamination direction of the laminated body to the second temperature range is not specifically limited as long as the amorphous alloy at the end portions in the lamination direction of the laminated body can be crystallized. For example, the method includes, for example, a method that brings a high temperature heat source into contact with an end surface in the lamination direction of the laminated body as in the example illustrated in FIGS. 2B and 4A, and radiation heating that uses a lamp. The high temperature heat source includes, for example, a high temperature plate with a good thermal conductivity configured of, for example, copper, a high temperature liquid, such as a salt bath, a heater, and a high frequency.

The method for bringing the high temperature heat source into contact with the end surface in the lamination direction of the laminated body is not specifically limited as long as the end portions in the lamination direction of the laminated body is heated to the second temperature range and is held for the period of time necessary for the crystallization. In the method, for example, it is possible to appropriately set a contact period, a contacted area, and the like depending on the number of laminations, the size of the alloy ribbon, and the like such that the whole laminated body can be crystallized without generating the precipitation of the compound phase and the coarsened crystal grains. For example, when the number of laminations of the alloy ribbon is small, the contact period can be set short, and when the number of laminations of the alloy ribbon is large, the contact period can be set long.

4. Ambient Temperature

In the method for manufacturing the alloy ribbon according to the embodiment, the ambient temperature around the laminated body is held after the first heat treatment step such that the laminated body is maintained within the temperature range (hereinafter, may be abbreviated as a "crystallizable temperature range") in which the laminated body can be crystallized by heating the end portion of the laminated body to the second temperature range in the second heat treatment step. In other words, after the first heat treatment step, the ambient temperature around the laminated body is held such that the laminated body is maintained within the temperature range in which the crystallization of the laminated body can occur by heating the end portion in the lamination direction of the laminated body to the second temperature range in the second heat treatment step. Specifically, after the first heat treatment step, the ambient temperature is held such that an amorphous portion of the alloy ribbon in the laminated body is maintained in the crystallizable temperature range.

The holding temperature of the ambient temperature is not specifically limited, and is different depending on the material and the like of the amorphous alloy ribbon. In the case of the Fe-based amorphous alloy, for example, it may be within a range of a lower limit of the first temperature range −10° C. or more and an upper limit of the first temperature range or less, it is within a range of the first temperature range in some embodiments. This is because, if it is excessively low, there is a possibility of failing to transmittingly generate the crystallization in the laminated body, and if it is excessively high, there is a possibility of occurrence of the coarsened crystal grains and the precipitation of the compound phase in the laminated body, and the cost is increased.

5. Relationship Between Respective Heat Amounts

In the method for manufacturing the alloy ribbon according to the embodiment, when the heat amount required to heat the laminated body to the first temperature range in the first heat treatment step is Q1, the heat amount given to the laminated body when the end portion of the laminated body is heated to the second temperature range in the second heat treatment step is Q2, the heat amount generated when the laminated body crystallizes is Q3, and the heat amount required to bring the whole laminated body to the crystallization starting temperature is Q4, the following formula (1) is satisfied. When the following formula (1) is not satisfied, the laminated body possibly fails to fully crystallize. Note that Q4 is, more specifically, a heat amount required to make the whole laminated body be in the crystallization starting temperature from a state before being heated with Q1 in the first heat treatment step in the temperature history of the laminated body when the laminated body is heated with Q1 in the first heat treatment step, the end portion in the lamination direction of the laminated body is heated with Q2 in the second heat treatment step, and the laminated body is heated with Q3 after the second heat treatment step. Q4 is, for example, in the above-described case, in particular, is a heat amount required to make the whole laminated body be in the crystallization starting temperature from a state before being heated with Q1 in the first heat treatment step in the temperature history of the laminated body when there is no heat movement between the laminated body and the outside except for being heated with Q1 and Q2.

$$Q1+Q2+Q3 \geq Q4 \quad (1)$$

In the case where the above-described formula (1) is satisfied, when a heat amount in Q1 required to heat each of the amorphous alloy ribbons in the laminated body to the first temperature range is Qa1, a heat amount given to the each of the amorphous alloy ribbons in Q2 is Qa2, a heat amount given to the each of the amorphous alloy ribbons in Q3 is Qa3, and a heat amount required to bring the whole each of the amorphous alloy ribbons to the crystallization starting temperature is Qa4, the following formula (1a) is satisfied for all the amorphous alloy ribbons in the laminated body in some embodiments. This is because it is possible to crystallize the whole of all the amorphous alloy ribbons. Note that Qa4 is, more specifically, a heat amount required to make the whole amorphous alloy ribbon be in the crystallization starting temperature from a state before being heated with Qa1 in the first heat treatment step in the temperature history of the each of the amorphous alloy ribbons when the each of the amorphous alloy ribbons in the laminated body is heated with Qa1 in the first heat treatment step, the each of the amorphous alloy ribbons is heated with Qa2 in the second heat treatment step, and the each of the amorphous alloy ribbons is heated with Qa3 after the second heat treatment step. Qa4 is, for example, in the above-described case, in particular, is a heat amount required to make the whole amorphous alloy ribbon be in the crystallization starting temperature from a state before being heated with Qa1 in the first heat treatment step in the temperature history of the amorphous alloy ribbon when there is no heat movement between the amorphous alloy ribbon and the outside except for being heated with Qa1, Qa2, and Qa3. Note that, the example illustrated in FIGS. 1A to 2B satisfies the following formula (1a).

$$Qa1+Qa2+Qa3 \geq Qa4 \quad (1a)$$

Note that, in the method for manufacturing the alloy ribbon according to the embodiment, since the whole laminated body is crystallized using the heat amount generated when the laminated body is crystallized, the heat amount (total of Q1 and Q2) provided from the outside does not exceed the heat amount (Q4) required to bring the whole laminated body to the crystallization starting temperature, and the following formula (2) is satisfied.

$$Q1+Q2<Q4 \quad (2)$$

In the method for manufacturing the alloy ribbon according to the embodiment, when a heat amount required to bring the whole laminated body to the compound phase precipitation starting temperature is Q5, the following formula (3) is satisfied in some embodiments. This is because it is possible to suppress the precipitation of the compound phase. Note that, Q5 is, more specifically, a heat amount required to make the whole laminated body be in the compound phase deposition starting temperature from the state before being heated with Q1 in the first heat treatment step in the temperature history of the laminated body when the laminated body is heated with Q1 in the first heat treatment step, the end portion in the lamination direction of the laminated body is heated with Q2 in the second heat treatment step, and the laminated body is heated with Q3 after the second heat treatment step. Q5 is, for example, in the above-described case, in particular, a heat amount required to make the whole laminated body be in the compound phase deposition starting temperature from a state before being heated with Q1 in the first heat treatment step in the temperature history of the laminated body when there is no heat movement between the laminated body and the outside except for being heated with Q1 and Q2.

$$Q1+Q2+Q3<Q5 \quad (3)$$

In the case where the above-described formula (3) is satisfied, when the heat amount in Q1 required to heat each of the amorphous alloy ribbons in the laminated body to the first temperature range is Qa1, the heat amount given to the each of the amorphous alloy ribbons in Q2 is Qa2, the heat amount given to the each of the amorphous alloy ribbons in Q3 is Qa3, and a heat amount required to bring the whole each of the amorphous alloy ribbons to the compound phase precipitation starting temperature is Qa5, the following formula (3a) is satisfied for all the amorphous alloy ribbons in the laminated body in some embodiments. This is because it is possible to suppress the precipitation of the compound phase in all the amorphous alloy ribbons. Note that, Qa5 is, more specifically, a heat amount required to make the whole amorphous alloy ribbon be in the compound phase deposition starting temperature from the state before being heated with Qa1 in the first heat treatment step in the temperature history of the each of the amorphous alloy ribbons when the each of the amorphous alloy ribbons in the laminated body is heated with Qa1 in the first heat treatment step, the each of the amorphous alloy ribbons is heated with Qa2 in the second heat treatment step, and the each of the amorphous alloy ribbons is heated with Qa3 after the second heat treatment step. Qa5 is, for example, in the above-described case, in particular, a heat amount required to make the whole amorphous alloy ribbon be in the compound phase deposition starting temperature from a state before being heated with Qa1 in the first heat treatment step in the temperature history of the amorphous alloy ribbon when there is no heat movement between the amorphous alloy ribbon and the outside except for being heated with Qa1, Qa2, and Qa3.

$$Qa1+Qa2+Qa3<Q5a \quad (3a)$$

6. Method for Manufacturing Alloy Ribbon

In the method for manufacturing the alloy ribbon according to the embodiment, crystallizing the laminated body from the end portion in the lamination direction heated to the second temperature range manufactures a plurality of the nanocrystalline alloy ribbons in which the plurality of amorphous alloy ribbons are crystallized in the laminated body.

Here, the "nanocrystalline alloy ribbon" means one that can obtain soft magnetic properties, such as desired coercivity and the like by precipitating fine crystal grains without substantially generating the precipitation of the compound phase and the coarsened crystal grains. A material of the nanocrystalline alloy ribbon is different depending on the material and the like of the amorphous alloy ribbon. In the case of the Fe-based amorphous alloy, the material is, for example, a Fe-based nanocrystalline alloy having a mixed phase structure of crystal grains of Fe or Fe alloy (e.g. fine bccFe crystal) and amorphous phase.

A grain diameter of crystal grains of the nanocrystalline alloy ribbon is not specifically limited as long as desired soft magnetic properties are obtained, and is different depending on the material and the like. In the case of the Fe-based nanocrystalline alloy, for example, the grain diameter is within a range of 25 nm or less in some embodiments. This is because coarsening deteriorates the coercivity.

Note that, the grain diameter of the crystal grains can be measured by a direct observation using a transmission electron microscope (TEM). The grain diameter of the crystal grains can be estimated from the coercivity or the temperature history of the nanocrystalline alloy ribbon.

The coercivity of the nanocrystalline alloy ribbon is different depending on the material and the like of the nanocrystalline alloy ribbon. In the case of the Fe-based nanocrystalline alloy, the coercivity may be, for example, 20 A/m or less, and is 10 A/m or less in some embodiments. This is because thus lowering the coercivity ensures effectively reducing, for example, a loss in a core of a motor and the like. Note that, since a condition, such as a temperature range in each of the heat treatment steps according to the embodiment, is restricted, the reduction of the coercivity of the nanocrystalline alloy ribbon has a limit.

Figure 11A:
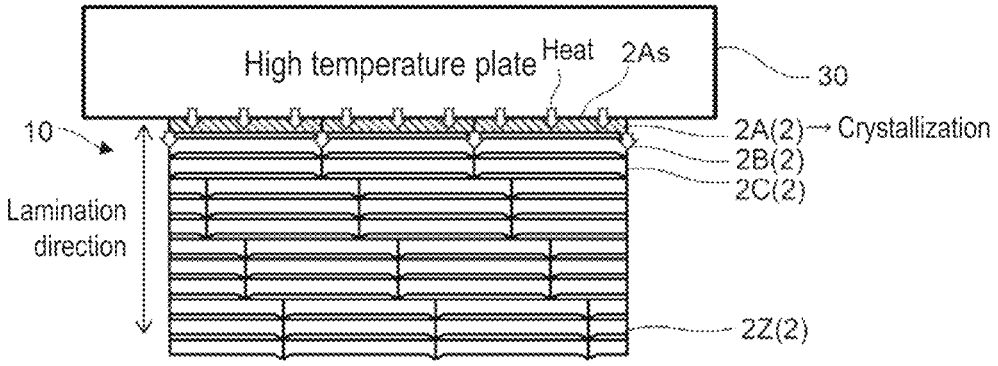
FIGS. 11A and 11B are schematic diagrams illustrating a second heat treatment step in another example of the method for manufacturing the alloy ribbon according to the embodiment and a crystallization by the second heat treatment step.
Figure 11B:
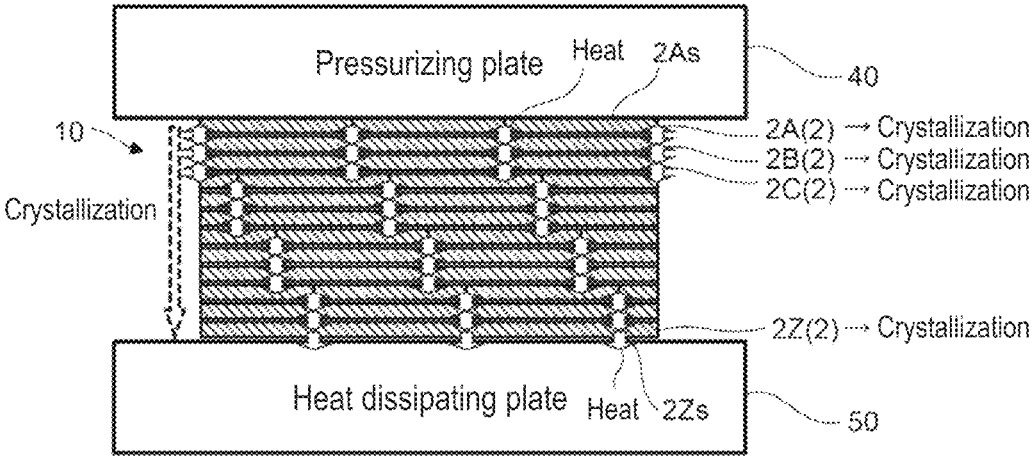

FIGS. 11A and 11B are schematic diagrams illustrating a second heat treatment step and a crystallization by the second heat treatment step in another exemplary method for manufacturing an alloy ribbon according to the embodiment.

In another method for manufacturing the alloy ribbon according to the embodiment, the laminated body 10 constituting a stator core is formed by rotating and laminating every three of the plurality of split ribbons 2 at an angle of 30 degrees in the laminated body forming step, and after heating the laminated body 10 to the first temperature range in the first heat treatment step, as illustrated in FIG. 11A, the whole first split ribbon 2A is heated to the second temperature range in the second heat treatment step. Thereafter, as illustrated in FIG. 11B, a pressurizing plate 40 is brought into contact with the surface 2As of the first split ribbon 2A, and a heat dissipating plate 50 is brought into contact with a surface 2Zs of the split ribbon 2Z at the end on the opposite side in the lamination direction of the first split ribbon 2A. In a state where the laminated body 10 is pressurized in the lamination direction with the pressurizing plate 40 and the heat dissipating plate 50, the crystallization and the generation of heat thereby repeatedly occur such that they are transmitted from the first split ribbon 2A to the split ribbon 2Z at the end on the opposite side in the lamination direction, and thus, the whole of all the split ribbons 2 in the laminated body 10 is crystallized (pressurizing step and heat dissipating step).

The method for manufacturing the alloy ribbon according to the embodiment, in some embodiments, further includes the pressurizing step of pressurizing the laminated body in the lamination direction after heating the end portion in the lamination direction of the laminated body to the second temperature range in the second heat treatment step as in the example illustrated in FIGS. 11A and 11B. This is because the crystallization is easily transmitted in the lamination direction since the heat conduction between the alloy ribbons in the lamination direction is enhanced. In particular, this is because, when a core used for a part is manufactured, the laminated body is prepared in the pressurized state, and therefore, heating in the assembled state ensures shortening the steps.

The method for manufacturing the alloy ribbon according to the embodiment, in some embodiments, further includes the heat dissipating step of bringing a heat dissipating member into contact with the end on the opposite side in the lamination direction of the above-described end portion in the laminated body as in the example illustrated in FIGS. 11A and 11B. This is because, the heat dissipating from the end on the opposite side in the lamination direction in the laminated body suppresses a heat accumulation caused by the heat generated in the crystallization in a portion close to the end on the opposite side, thereby ensuring suppressing the generation of the coarsened crystal grains and the precipitation of the compound phase. Note that, while the heat dissipating step may be a step of bringing a heat dissipating member into contact with the end on the opposite side before heating the end portion of the laminated body to the second temperature range in the second heat treatment step or may be a step of bringing a heat dissipating member into contact with the end on the opposite side after heating the end portion of the laminated body to the second temperature range in the second heat treatment step, usually, the heat dissipating step is the step of bringing the heat dissipating member into contact with the end on the opposite side after heating the end portion of the laminated body to the second temperature range in the second heat treatment step as in the example illustrated in FIGS. 11A and 11B. This is because the heat accumulation can be effectively suppressed.

The method for manufacturing the alloy ribbon according to the embodiment is not specifically limited as long as the plurality of nanocrystalline alloy ribbons can be manufactured. In some embodiments, for example, the manufacturing method crystallizes the whole laminated body (specifically, for example, the whole of all the amorphous alloy ribbons in the laminated body), and makes the crystal grains of the nanocrystalline alloy ribbon have a desired grain diameter without substantially generating the precipitation of the compound phase and the coarsened crystal grains. In the above-described method for manufacturing the alloy ribbon, in order to crystallize the whole laminated body, and make the crystal grains of the nanocrystalline alloy ribbon have the desired grain diameter, without substantially generating the precipitation of the compound phase and the coarsened crystal grains, it is possible to suitably set other conditions besides the conditions described so far. Not only independently and suitably setting each condition, a combination of each condition can also be suitably set.

EXAMPLES

The following specifically describes the method for manufacturing the alloy ribbon according to the embodiment with examples and comparative examples.

[Evaluation of Thickness of Amorphous Alloy Ribbon]

A description will be given of results of evaluating thicknesses in the width direction of products A to D of the amorphous alloy ribbon. Note that the products A to D are alloy ribbons having a width W of 50 mm configured of a Fe-based amorphous alloy having a content of Fe of 84 atomic % or more.

Figure 12:
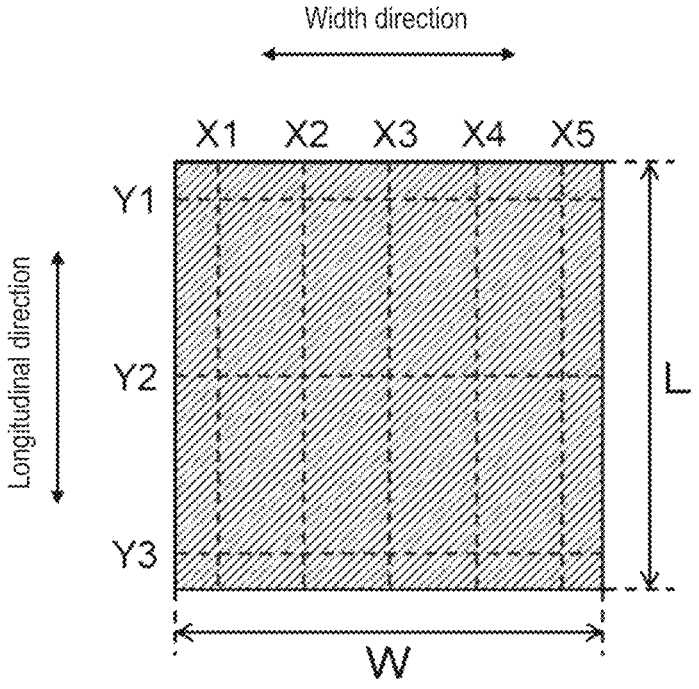
FIG. 12 is a schematic plan view illustrating a specimen of products A to D of the amorphous alloy ribbon.

The evaluation of the thicknesses of the products A to D in the width direction was performed using specimens of the respective products A to D. FIG. 12 is a schematic plan view illustrating the specimen of the products A to D of the amorphous alloy ribbon.

As illustrated in FIG. 12, the specimen of the product A is a specimen having a length L, which is a cut out part in the longitudinal direction of the product A, of 150 mm. The specimens of the products B to D are specimens having lengths L, which are cut out parts in the longitudinal direction of the respective products B to D, of 50 mm. The evaluation of the thicknesses in the width direction of the products A to D was performed by measuring thicknesses of respective positions of X1 to X5 between one ends and the other ends in the width direction in respective positions of Y1 to Y3 between one ends and the other ends in the longitudinal direction of the respective specimens. Note that the positions of Y1 to Y3 are positions 1 mm apart from one ends toward the other ends side in the longitudinal direction, positions apart by half the length L from the one ends toward the other ends side in the longitudinal direction, and positions 1 mm apart from the other ends toward the one ends in the longitudinal direction. The positions of X1 to X5 are positions apart by 5 mm, 15 mm, 25 mm, 35 mm, and 45 mm from one ends toward the other ends side in the width direction, respectively.

Figure 13:
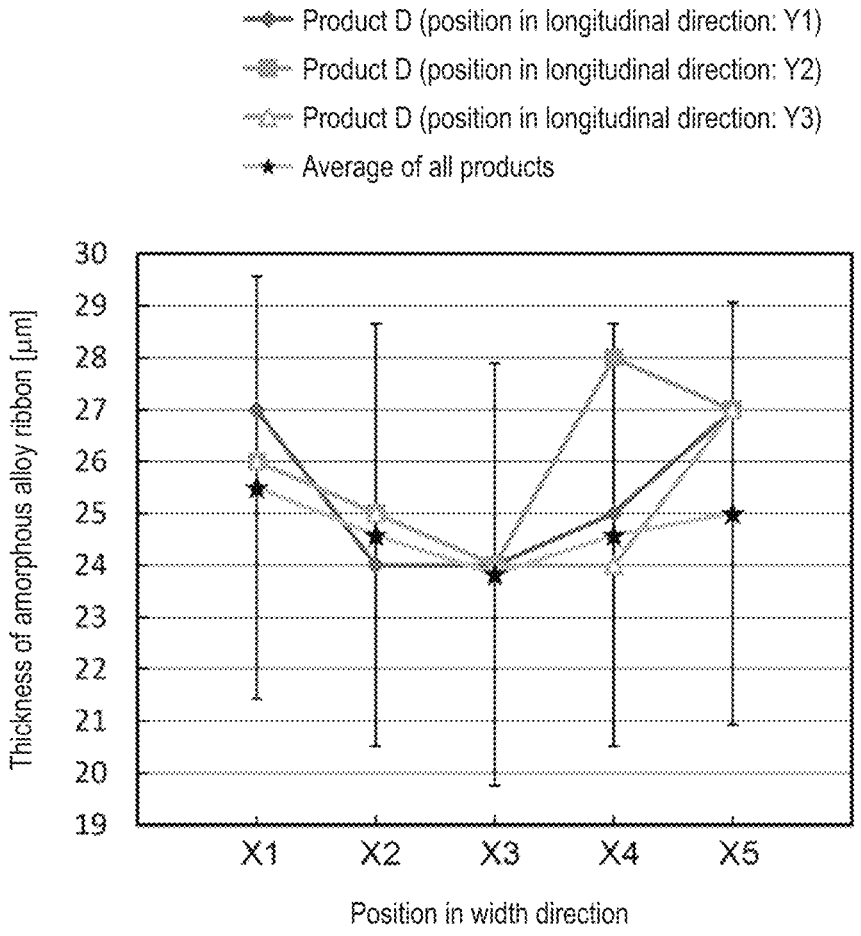
FIG. 13 is a graph illustrating thicknesses at respective positions in a width direction at each position in a longitudinal direction of the specimen of the product D of the amorphous alloy ribbon, and averages of thicknesses at respective positions in the width direction of the specimens of the products A to D of the amorphous alloy ribbon.

FIG. 13 is a graph illustrating thicknesses of the respective positions in the width direction at each position in the longitudinal direction of the specimen of the product D of the amorphous alloy ribbon and averages of thicknesses at the respective positions in the width direction of the specimens of the products A to D of the amorphous alloy ribbon.

The specimen of the product D had a tendency to have both end portions in the width direction thicker than the center portions in all the positions in the longitudinal direction as illustrated in FIG. 13. The averages of the thicknesses of the respective positions in the width direction of the specimens of the products A to D also had a tendency to have both end portions in the width direction thicker than the center portions as illustrated in FIG. 13.

Example

Figure 14A:
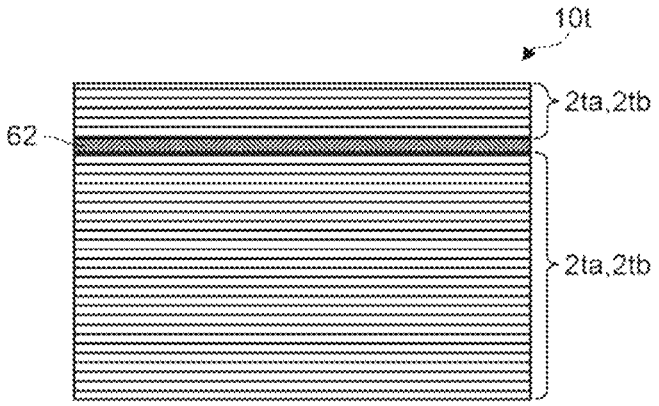
FIGS. 14A and 14B are schematic process drawings illustrating an experiment of a method for manufacturing an alloy ribbon in an example.
Figure 14B:
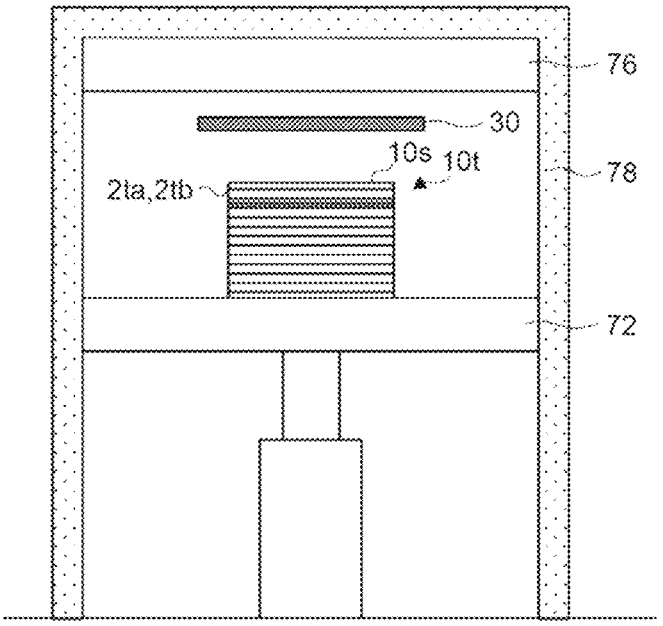
Figure 15:
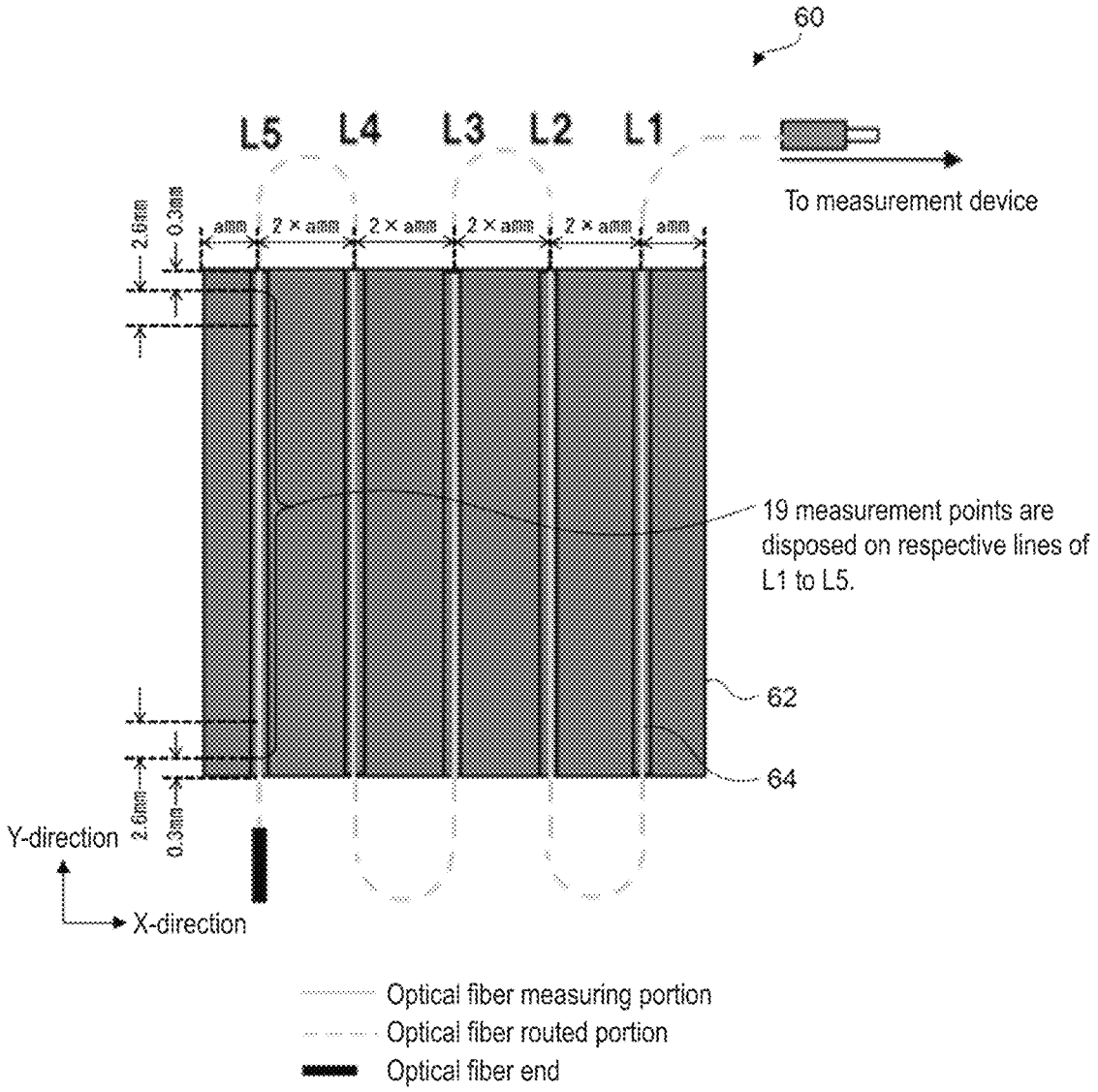
FIG. 15 is a schematic diagram illustrating a temperature measurement device (an optical fiber temperature measuring device manufactured by Fuji Technical Research Inc.) used in the experiment of the method for manufacturing the alloy ribbon.

An experiment of the method for manufacturing the alloy ribbon according to the embodiment was performed. FIGS. 14A and 14B are schematic process drawings illustrating the experiment of the method for manufacturing the alloy ribbon of the example. FIG. 15 is a schematic diagram illustrating a temperature measurement device (optical fiber temperature measuring device made by Fuji Technical Research Inc.) used in the experiment of the method for manufacturing the alloy ribbon.

In the experiment, first, 250 ribbon materials 2*t* having a length L, which is a cut out part in the longitudinal direction of the product D of the amorphous alloy ribbon, of 50 mm were prepared. The ribbon material 2*t* has a tendency to have both the end portions in the width direction thicker than the center portions as described above. Furthermore, by splitting this ribbon material 2*t* at the center in the width direction, 250 ribbon materials 2*ta* and 250 ribbon materials 2*tb* were manufactured. The ribbon materials 2*ta* had one end portion in the width direction thicker than the other end portion. The ribbon materials 2*tb* had the one end portion in the width direction thinner than the other end portion.

Next, as illustrated in FIG. 14A, 250 ribbon materials 2*ta* and 250 ribbon materials 2*tb* were alternately laminated such that positions of relatively thick one end portions in the width direction of the ribbon materials 2*ta* and relatively thin one end portions of the ribbon materials 2*tb* corresponded, and positions of relatively thin other end portions in the width direction of the ribbon materials 2*ta* and relatively thick other end portions of the ribbon materials 2*tb* corresponded, to form a laminated body 10*t* (laminated body forming step). At this time, a temperature measuring plate 62 of a temperature measurement device 60 illustrated in FIG. 15 was disposed to be interposed between the 80th ribbon material 2*ta* (ribbon material of temperature measurement target) and the 81st ribbon material 2*tb* from the upper end in the lamination direction in the laminated body 10*t*. At this time, the temperature measuring plate 62 had the X-direction and the Y-direction corresponding to the width direction and the longitudinal direction, respectively, of these ribbon materials.

Next, as illustrated in FIG. 14B, in an ordinary temperature space between a lower base 72 and an upper base 76 enclosed by a heat dissipation suppressing member 78, the laminated body 10*t* was disposed on an upper surface of the lower base 72. Subsequently, using a facility illustrated in FIG. 14B, the upper base 76 pressurized the laminated body 10*t* to be at a pressure of 5 MPa in the lamination direction. In this state, the inside of the space between the lower base 72 and the upper base 76 enclosed by the heat dissipation suppressing member 78 was heated to 320° C. with a heater (not illustrated) to uniformly heat the laminated body 10*t* to the first temperature range less than the crystallization starting temperature (first heat treatment step).

Next, using the facility illustrated in FIG. 14B, after the upper base 76 was once removed, while the high temperature plate 30 uniformly heated to 470° C. was placed on an top end surface 10*s* in the lamination direction of the laminated body 10*t*, the upper base 76 caused the laminated body 10*t* to be pressurized at a pressure of 5 MPa in the lamination direction via the high temperature plate 30, and this state was held. This heated the ribbon material on the upper end in the lamination direction in the laminated body 10*t* to the second temperature range equal to or more than the crystallization starting temperature (second heat treatment step).

In the experiment, the ambient temperature around the laminated body 10*t* was held after the first heat treatment step such that the whole laminated body 10*t* was maintained within the temperature range in which the whole laminated body 10*t* can be crystallized by heating the ribbon material on the upper end in the lamination direction in the laminated body 10*t* to the temperature range equal to or more than the crystallization starting temperature in the second heat treatment step. The formula (1) according to the embodiment was satisfied.

Figure 16:
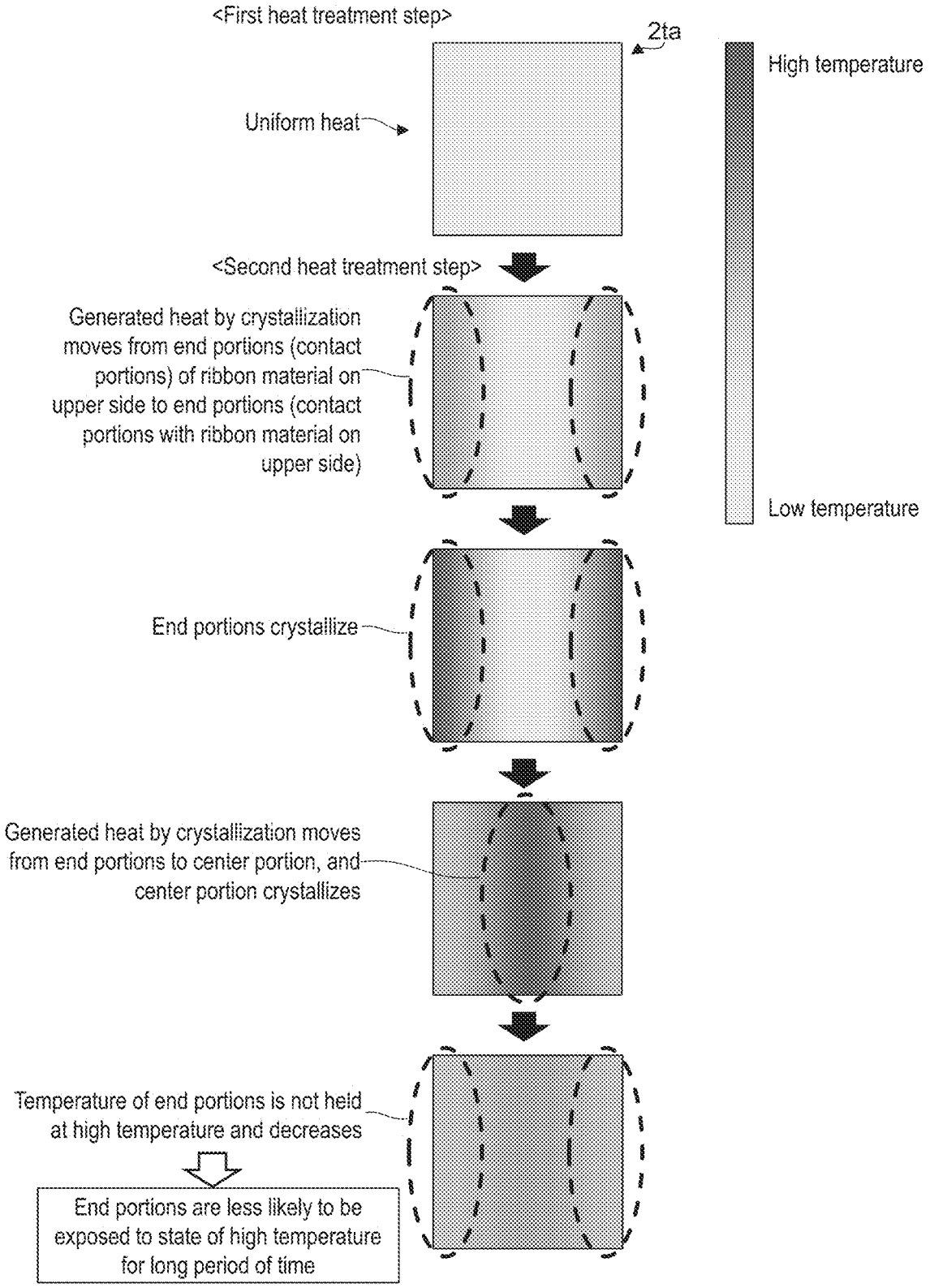
FIG. 16 is a drawing schematically illustrating a temperature change in and after a first heat treatment step of an 80th ribbon material from an upper end in the example.

In the experiment, in and after the first heat treatment step, using the temperature measurement device 60 illustrated in FIG. 15, temperatures of respective positions in the planar direction of the 80th ribbon material 2*ta* from the upper end were measured. Specifically, an optical fiber 64 routed around to pass in grooves of respective lines of L1 to L5 disposed on the temperature measuring plate 62 included in the temperature measurement device 60 measured the temperatures of the respective positions in the planar direction of the 80th ribbon material 2*ta* from the upper end at 19 measurement points disposed on the respective lines of L1 to L5. FIG. 16 is the drawing schematically illustrating temperature changes in and after the first heat treatment step of the 80th ribbon material from the upper end in the example. The following describes the temperature changes.

First, as illustrated in FIG. 16, the first heat treatment step uniformly heated the 80th ribbon material 2*ta* from the upper end. Subsequently, when the second heat treatment step heated the ribbon material on the upper end to the temperature range equal to or more than the crystallization starting temperature, in a process where the crystallization and the generation of heat thereby repeatedly occurred such that they were transmitted to the lower end ribbon material from the upper end ribbon material, as illustrated in FIG. 16, first, the heat generated in the crystallization moved from the end portions (contact portions) of the ribbon material on the upper side to the end portions (contact portions with the ribbon material on the upper side) in the 80th ribbon material 2*ta* from the upper end. Subsequently, the end portions were crystallized, the heat generated in the crystallization moved from the end portions to the center portion, and the center portion were crystallized. Afterwards, the temperatures of the end portions were not held at high temperature and decreased. Note that the pressure applied when the ribbon material on the lower side closely contacts the 80th ribbon material 2*ta* (ribbon material of temperature measurement target) from the upper end did not concentrate in the end portions in the width direction and was dispersed.

Comparative Example 1

Figure 17A:
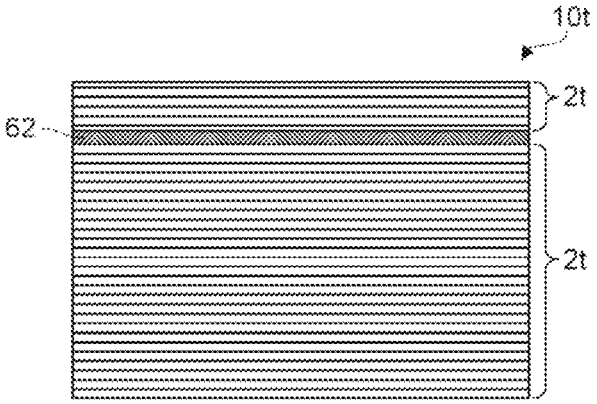
FIGS. 17A and 17B are schematic process drawings illustrating an experiment of a method for manufacturing an alloy ribbon in a comparison example 1.
Figure 17B:
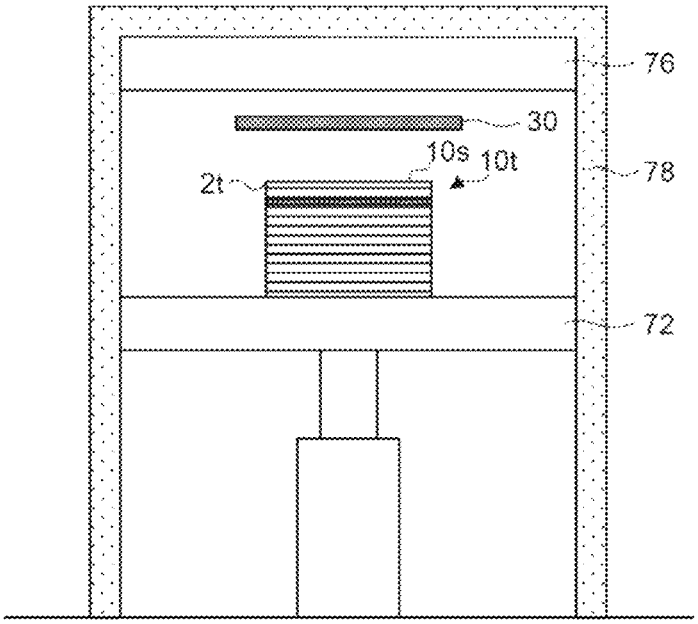

An experiment of the method for manufacturing the alloy ribbon was performed. FIGS. 17A and 17B are schematic process drawings illustrating the experiment of the method for manufacturing the alloy ribbon in the comparative example 1.

In the experiment, first, 500 ribbon materials 2*t* having a length L, which was a cut out part in the longitudinal direction of the product D of the amorphous alloy ribbon, of 50 mm were prepared. The ribbon material 2*t* has a tendency to have both the end portions in the width direction thicker than the center portion as described above.

Next, as illustrated in FIG. 17A, 500 ribbon materials 2*t* were laminated such that positions at both ends in the width direction of one another corresponded to form the laminated body 10*t* (laminated body forming step). At this time, the temperature measuring plate 62 of the temperature measurement device 60 illustrated in FIG. 15 was disposed to be interposed between the 80th ribbon material 2*t* (ribbon material of temperature measurement target) and the 81st ribbon material 2*t* from the upper end in the lamination direction in the laminated body 10*t*. At this time, the temperature measuring plate 62 had the X-direction and the Y-direction corresponding to the width direction and the longitudinal direction, respectively, of these ribbon materials.

Next, as illustrated in FIG. 17B, in an ordinary temperature space between the lower base 72 and the upper base 76 enclosed by the heat dissipation suppressing member 78, the laminated body 10*t* was disposed on the upper surface of the lower base 72. Subsequently, using a facility illustrated in FIG. 17B, the upper base 76 caused the laminated body 10*t* to be pressurized at a pressure of 5 MPa in the lamination direction. In this state, the inside of the space between the lower base 72 and the upper base 76 enclosed by the heat dissipation suppressing member 78 was heated to 320° C. with a heater (not illustrated) to uniformly heat the laminated body 10*t* to the first temperature range less than the crystallization starting temperature (first heat treatment step).

Next, using the facility illustrated in FIG. 17B, after the upper base 76 was once removed, while the high temperature plate 30 uniformly heated to 470° C. was placed on the top end surface 10*s* in the lamination direction of the laminated body 10*t*, the upper base 76 caused the laminated body 10*t* to be pressurized at a pressure of 5 MPa in the lamination direction via the high temperature plate 30, and this state was held. This heated the ribbon material 2*t* on the upper end in the lamination direction in the laminated body 10*t* to the second temperature range equal to or more than the crystallization starting temperature (second heat treatment step).

In the experiment, the ambient temperature around the laminated body 10*t* was held after the first heat treatment step such that the whole laminated body 10*t* was maintained within the temperature range in which the whole laminated body 10*t* can be crystallized by heating the ribbon material 2*t* on the upper end in the lamination direction in the laminated body 10*t* to the temperature range equal to or more than the crystallization starting temperature in the second heat treatment step. The formula (1) according to the embodiment was satisfied.

Figure 18:
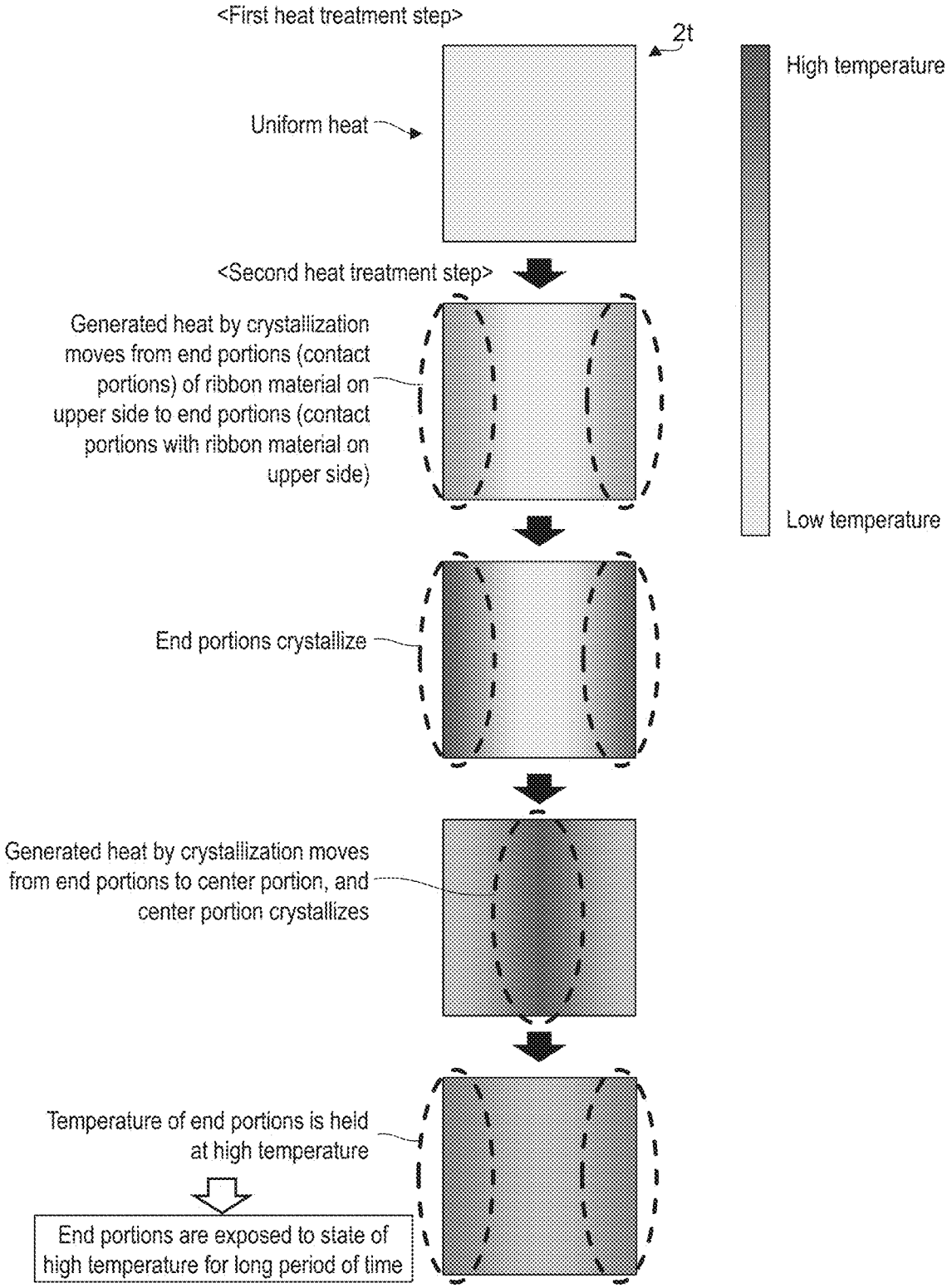
FIG. 18 is a drawing schematically illustrating a temperature change in and after a first heat treatment step of an 80th ribbon material from an upper end in the comparison example 1.

In the experiment, in and after the first heat treatment step, using the temperature measurement device 60 illustrated in FIG. 15, temperatures of respective positions in the planar direction of the 80th ribbon material 2*t* from the upper end were measured with a method similar to the example. FIG. 18 is the drawing schematically illustrating temperature changes in and after the first heat treatment step of the 80th ribbon material from the upper end in the comparative example 1. The following describes the temperature changes.

First, as illustrated in FIG. 18, the first heat treatment step uniformly heated the 80th ribbon material 2*t* from the upper end. Subsequently, when the second heat treatment step heated the ribbon material 2*t* on the upper end to the temperature range equal to or more than the crystallization starting temperature, in a process where the crystallization and the generation of heat thereby repeatedly occurred such that they were transmitted to the lower end ribbon material 2*t* from the upper end ribbon material 2*t*, as illustrated in FIG. 18, first, the heat generated in the crystallization moved from the end portions (contact portions) of the ribbon material on the upper side to the end portions (contact portions with the ribbon material on the upper side) in the 80th ribbon material 2*t* from the upper end. Subsequently, the end portions were crystallized, the heat generated in the crystallization moved from the end portions to the center portion, and the center portion were crystallized. Afterwards, the temperatures of the end portions were held at high temperature. This is because the heat generated in the crystallization moved from the end portions (contact portions) of the ribbon material on the lower side to the end portions (contact portions with the ribbon material on the lower side) of the 80th ribbon material 2*t* from the upper end, since the pressure applied when the ribbon material on the lower side closely contacts the 80th ribbon material 2*t* (ribbon material of temperature measurement target) from the upper end concentrated in the end portions in the width direction in the laminated body 10*t*. Because of these, the end portions of the 80th ribbon material 2*t* were resulted to be exposed to the state of high temperature for a long period of time. Note that the temperature of the end portions of the 80th ribbon material 2*t* was held at equal to or less than the temperature at which the precipitation of the compound phase starts.

Comparative Example 2

Figure 19A:
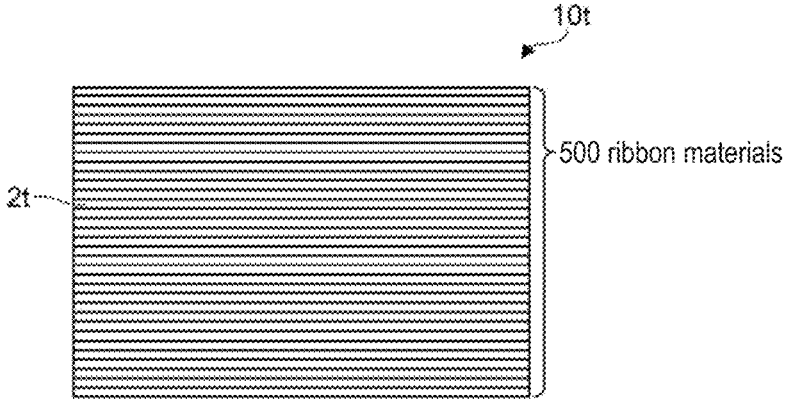
FIGS. 19A and 19B are schematic process drawings illustrating an experiment of a method for manufacturing an alloy ribbon in a comparison example 2.
Figure 19B:
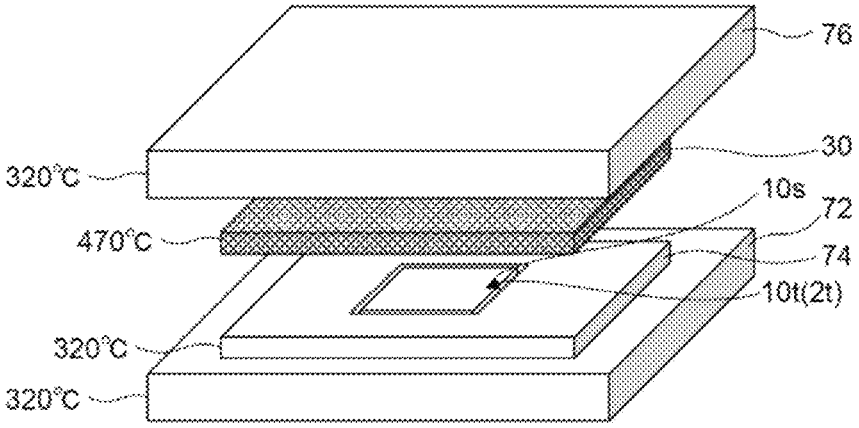

An experiment of the method for manufacturing the alloy ribbon was performed. FIGS. 19A and 19B are schematic process drawings illustrating the experiment of the method for manufacturing the alloy ribbon in the comparative example 2.

In the experiment, first, 500 ribbon materials 2*t* having a length L, which was a cut out part in the longitudinal direction of the product D of the amorphous alloy ribbon, of 50 mm were prepared. The ribbon material 2*t* has a tendency to have both the end portions in the width direction thicker than the center portion as described above.

Next, as illustrated in FIG. 19A, 500 ribbon materials 2*t* were laminated such that positions at both ends in the width direction of one another corresponded to form the laminated body 10*t* (laminated body forming step).

Next, using a facility illustrated in FIG. 19B, the laminated body 10*t* was disposed on the upper surface of the lower base 72 uniformly heated to 320° C., while surrounding the peripheral area of the laminated body 10*t* with the heat dissipation suppressing member 74 uniformly heated to 320° C., and the upper base 76 uniformly heated to 320° C. was disposed on them, and this state was held for 700 seconds. This uniformly heated the whole laminated body 10*t* to the first temperature range less than the crystallization starting temperature (first heat treatment step).

Next, using the facility illustrated in FIG. 19B, after the upper base 76 was once removed, while the high temperature plate 30 uniformly heated to 470° C. was placed on the top end surface 10*s* in the lamination direction of the laminated body 10*t*, the upper base 76 caused the laminated body 10*t* to be pressurized at a pressure of 5 MPa in the lamination direction via the high temperature plate 30, and this state was held for 60 seconds. This heated the ribbon material 2*t* on the upper end in the lamination direction in the laminated body 10*t* to the second temperature range equal to or more than the crystallization starting temperature or more (second heat treatment step).

In the experiment, the ambient temperature around the laminated body 10*t* was held after the first heat treatment step such that the whole laminated body 10*t* was maintained within the temperature range in which the whole laminated body 10*t* can be crystallized by heating the ribbon material 2*t* on the upper end in the lamination direction in the laminated body 10*t* to the temperature range equal to or more than the crystallization starting temperature in the second heat treatment step. The formula (1) according to the embodiment was satisfied.

Figure 20:
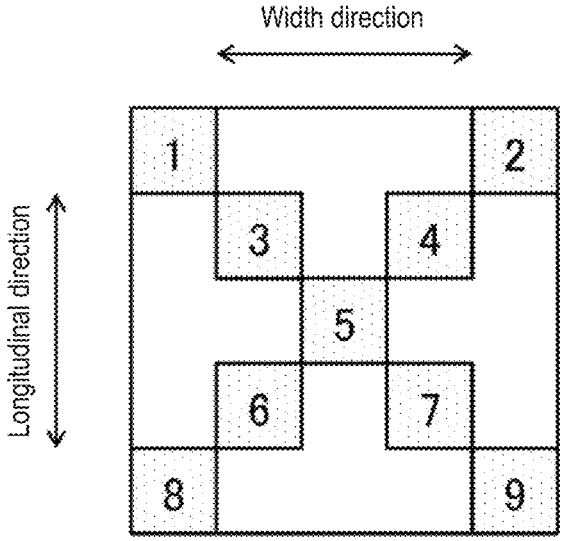
FIG. 20 is a schematic diagram illustrating positions in the planar direction of a hundredth ribbon material from an upper end from which coercivities were measured.
Figure 21:
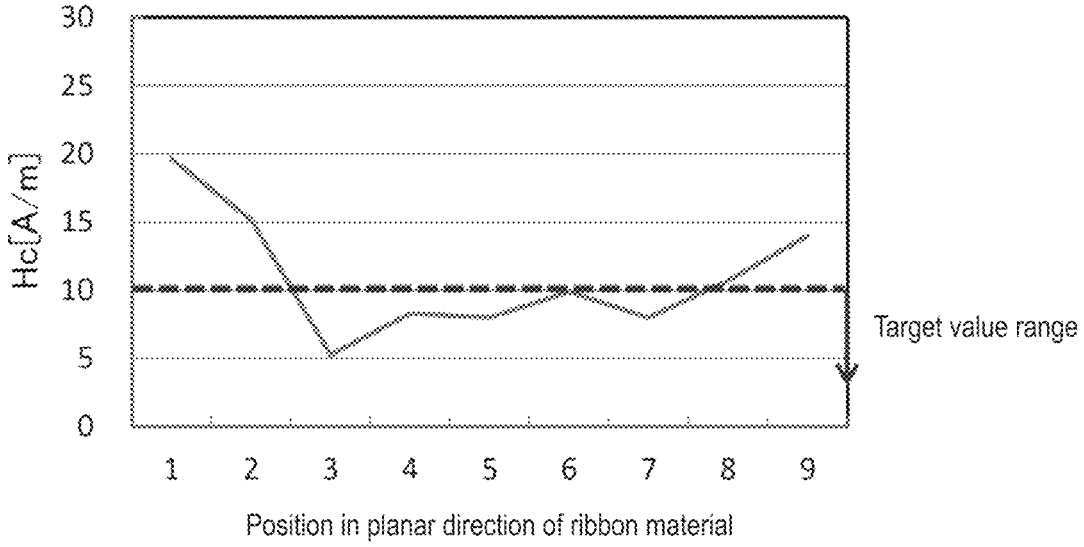
FIG. 21 is a graph illustrating coercivities Hc at respective positions in the planar direction of a hundredth ribbon material 2*t* from the upper end.

A coercivity Hc at each position in the planar direction of the hundredth ribbon material 2*t* from the upper end in the lamination direction in the laminated body 10*t* after the crystallization obtained by this experiment were measured using a vibrating sample magnetometer (VSM). FIG. 20 is a schematic diagram illustrating positions in the planar direction of the hundredth ribbon material from the upper end from which the coercivities were measured. FIG. 21 is a graph illustrating the coercivities Hc at the respective positions in the planar direction of the hundredth ribbon material 2*t* from the upper end.

As illustrated in FIG. 21, in the hundredth ribbon material 2*t* from the upper end, the coercivities Hc at the positions of 1, 2, 8, and 9 in the planar direction illustrated in FIG. 20 exceeded the upper limit (10 A/m) of the target range, and the coercivities Hc at the other positions fell within the target range.

While the embodiment of the method for manufacturing the alloy ribbon according to the present disclosure has been described in detail above, the present disclosure is not limited thereto, and can be subjected to various kinds of changes in design without departing from the spirit and scope of the present disclosure described in the claims.

All publications, patents and patent applications cited in the present description are herein incorporated by reference as they are.

DESCRIPTION OF SYMBOLS

2 Split ribbon (amorphous alloy ribbon)
2*e* End portion in width direction of split ribbon (relatively thick portion)
2*m* Center portion in width direction of split ribbon
10 Laminated body of split ribbon
20*a* First heating furnace
20*b* Second heating furnace
30 High temperature plate

What is claimed is:

1. A method for manufacturing a laminated body of nanocrystalline alloy ribbons, comprising:

forming a laminated body by laminating a plurality of amorphous alloy ribbons such that positions of thick portions of the plurality of amorphous alloy ribbons are shifted in a circumferential direction of the laminated body relative to each other;

heating the laminated body to a first temperature range less than a crystallization starting temperature of the amorphous alloy ribbon;

after heating the laminated body to the first temperature range, holding the laminated body in an ambient temperature;

while maintaining the laminated body in the ambient temperature, heating a first amorphous alloy ribbon at one end of the laminated body in a lamination direction to a second temperature range equal to or more than the crystallization starting temperature, while maintaining the remaining amorphous alloy ribbons within a temperature range less than the crystallization starting temperature; and after heating the first amorphous alloy ribbon to the second temperature range, while maintaining the laminated body in the ambient temperature, propagating crystallization and generation of heat through the laminated body from the first amorphous alloy ribbon to an amorphous alloy ribbon at the opposite end of the laminated body in a lamination direction to manufacture a plurality of nanocrystalline alloy ribbons in which the plurality of amorphous alloy ribbons are crystallized in the laminated body, wherein the ambient temperature is a temperature range in which the laminated body crystallizes by propagation of the generation of heat after heating the first amorphous alloy ribbon to the second temperature range.

2. The method for manufacturing a laminated body of nanocrystalline alloy ribbons according to claim 1, further comprising pressurizing the one end of the laminated body in the lamination direction after heating the first amorphous alloy ribbon to the second temperature range.

3. The method for manufacturing a laminated body of nanocrystalline alloy ribbons according to claim 1, further comprising bringing a heat dissipating member into contact with the amorphous alloy ribbon at the opposite end of the laminated body before or after heating the first amorphous alloy ribbon to the second temperature range.

* * * * *